US008866689B2

(12) United States Patent
Islam

(10) Patent No.: US 8,866,689 B2
(45) Date of Patent: Oct. 21, 2014

(54) MULTI-BAND ANTENNA AND METHODS FOR LONG TERM EVOLUTION WIRELESS SYSTEM

(75) Inventor: Muhammad Nazrul Islam, Oulu (FI)

(73) Assignee: Pulse Finland OY, Kempele (FI)

( * ) Notice: Subject to any disclaimer, the term of this patent is extended or adjusted under 35 U.S.C. 154(b) by 356 days.

(21) Appl. No.: 13/178,400

(22) Filed: Jul. 7, 2011

(65) Prior Publication Data

US 2013/0009836 A1 Jan. 10, 2013

(51) Int. Cl.

| | |
|---|---|
| ***H01Q 5/00*** | (2006.01) |
| ***H01Q 9/16*** | (2006.01) |
| ***H01Q 1/24*** | (2006.01) |
| ***H01Q 21/30*** | (2006.01) |

(52) U.S. Cl.

CPC ..... *H01Q 1/241* (2013.01); *H01Q 21/30* (2013.01)

USPC ..... 343/810; 343/702; 343/700 MS

(58) Field of Classification Search

USPC ..... 343/810

See application file for complete search history.

(56) References Cited

U.S. PATENT DOCUMENTS

| | | | | |
|---|---|---|---|---|
| 2,745,102 | A | 5/1956 | Norgorden | |
| 3,938,161 | A | 2/1976 | Sanford | |
| 4,004,228 | A | 1/1977 | Mullett | |
| 4,005,430 | A * | 1/1977 | Dubost et al. | 343/747 |
| 4,028,652 | A | 6/1977 | Wakino et al. | |
| 4,031,468 | A | 6/1977 | Ziebell et al. | |
| 4,054,874 | A | 10/1977 | Oltman | |
| 4,069,483 | A | 1/1978 | Kaloi | |
| 4,123,756 | A | 10/1978 | Nagata et al. | |
| 4,123,758 | A | 10/1978 | Shibano et al. | |
| 4,131,893 | A | 12/1978 | Munson et al. | |
| 4,201,960 | A | 5/1980 | Skutta et al. | |
| 4,255,729 | A | 3/1981 | Fukasawa et al. | |
| 4,313,121 | A | 1/1982 | Campbell et al. | |
| 4,356,492 | A | 10/1982 | Kaloi | |

(Continued)

FOREIGN PATENT DOCUMENTS

| | | |
|---|---|---|
| CN | 1316797 | 10/2007 |
| DE | 10104862 | 8/2002 |

(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

(Continued)

*Primary Examiner* — Michael C Wimer
*Assistant Examiner* — Michael Bouizza
(74) *Attorney, Agent, or Firm* — Gazdzinski & Associates, PC.

(57) ABSTRACT

A multiband dipole antenna solution suitable for use in various wireless device applications, and methods of tuning and utilizing the same. In one embodiment, the antenna is adapted for use in long term evolution (LTE or LTE-A) radio devices. In one implementation, the antenna comprises (i) two planar directly fed radiating elements operating in a lower frequency band and disposed on two opposing sides of a dielectric structure, and (ii) two electromagnetically coupled radiating elements operating in an upper frequency band also disposed on the opposing sides of the dielectric structure. An additional pair of electromagnetically coupled radiator elements is utilized to achieve wider antenna operating bandwidth.

28 Claims, 25 Drawing Sheets

(56) References Cited

U.S. PATENT DOCUMENTS 4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,653,889 A 3/1987 Haneishi
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanene
5,053,786 A 10/1991 Silverman et al.
5,057,847 A 10/1991 Vaisanen
5,061,939 A 10/1991 Nakase
5,097,236 A 3/1992 Wakino et al.
5,103,197 A 4/1992 Turunen et al.
5,109,536 A 4/1992 Kommrusch
5,155,493 A 10/1992 Thursby et al.
5,157,363 A 10/1992 Puurunen et al.
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,280 A 8/1995 Baudart
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prodhomme et al.
5,668,561 A 9/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa et al.
5,999,132 A 12/1999 Kitchener et al.

(56) References Cited

U.S. PATENT DOCUMENTS

| | | | |
|---|---|---|---|
| 6,005,529 | A | 12/1999 | Hutchinson |
| 6,006,419 | A | 12/1999 | Vandendolder et al. |
| 6,008,764 | A | 12/1999 | Ollikainen |
| 6,009,311 | A | 12/1999 | Killion et al. |
| 6,014,106 | A | 1/2000 | Annamaa |
| 6,016,130 | A | 1/2000 | Annamaa |
| 6,023,608 | A | 2/2000 | Yrjola |
| 6,031,496 | A | 2/2000 | Kuittinen et al. |
| 6,034,637 | A | 3/2000 | McCoy et al. |
| 6,037,848 | A | 3/2000 | Alila |
| 6,043,780 | A | 3/2000 | Funk et al. |
| 6,052,096 | A | 4/2000 | Tsuru et al. |
| 6,072,434 | A | 6/2000 | Papatheodorou |
| 6,078,231 | A | 6/2000 | Pelkonen |
| 6,091,363 | A | 7/2000 | Komatsu et al. |
| 6,091,365 | A | 7/2000 | Derneryd et al. |
| 6,097,345 | A | 8/2000 | Walton |
| 6,100,849 | A | 8/2000 | Tsubaki et al. |
| 6,112,106 | A | 8/2000 | Crowley et al. |
| 6,121,931 | A | 9/2000 | Levi et al. |
| 6,133,879 | A | 10/2000 | Grangeat et al. |
| 6,134,421 | A | 10/2000 | Lee et al. |
| 6,140,966 | A | 10/2000 | Pankinaho |
| 6,140,973 | A | 10/2000 | Annamaa |
| 6,147,650 | A | 11/2000 | Kawahata et al. |
| 6,157,819 | A | 12/2000 | Vuokko |
| 6,177,908 | B1 | 1/2001 | Kawahata |
| 6,185,434 | B1 | 2/2001 | Hagstrom |
| 6,190,942 | B1 | 2/2001 | Wilm et al. |
| 6,195,049 | B1 | 2/2001 | Kim et al. |
| 6,204,826 | B1 | 3/2001 | Rutkowski et al. |
| 6,215,376 | B1 | 4/2001 | Hagstrom |
| 6,246,368 | B1 | 6/2001 | Deming et al. |
| 6,252,552 | B1 | 6/2001 | Tarvas et al. |
| 6,252,554 | B1 | 6/2001 | Isohatala |
| 6,255,994 | B1 | 7/2001 | Saito |
| 6,268,831 | B1 | 7/2001 | Sanford |
| 6,281,848 | B1 | 8/2001 | Nagumo et al. |
| 6,295,029 | B1 | 9/2001 | Chen et al. |
| 6,297,776 | B1 | 10/2001 | Pankinaho |
| 6,304,220 | B1 | 10/2001 | Herve et al. |
| 6,308,720 | B1 | 10/2001 | Modi |
| 6,316,975 | B1 | 11/2001 | O'Toole et al. |
| 6,323,811 | B1 | 11/2001 | Tsubaki |
| 6,326,921 | B1 | 12/2001 | Egorov et al. |
| 6,337,663 | B1 | 1/2002 | Chi-Minh |
| 6,340,954 | B1 | 1/2002 | Annamaa et al. |
| 6,342,859 | B1 | 1/2002 | Kurz et al. |
| 6,343,208 | B1 | 1/2002 | Ying |
| 6,346,914 | B1 | 2/2002 | Annamaa |
| 6,348,892 | B1 | 2/2002 | Annamaa |
| 6,353,443 | B1 | 3/2002 | Ying |
| 6,366,243 | B1 | 4/2002 | Isohatala |
| 6,377,827 | B1 | 4/2002 | Rydbeck |
| 6,380,905 | B1 | 4/2002 | Annamaa |
| 6,396,444 | B1 | 5/2002 | Goward |
| 6,404,394 | B1 | 6/2002 | Hill |
| 6,417,813 | B1 | 7/2002 | Durham et al. |
| 6,421,014 | B1 | 7/2002 | Sanad |
| 6,423,915 | B1 | 7/2002 | Winter |
| 6,429,818 | B1 | 8/2002 | Johnson et al. |
| 6,452,551 | B1 | 9/2002 | Chen |
| 6,452,558 | B1 | 9/2002 | Saitou et al. |
| 6,456,249 | B1 | 9/2002 | Johnson et al. |
| 6,459,413 | B1 | 10/2002 | Tseng et al. |
| 6,462,716 | B1 | 10/2002 | Kushihi |
| 6,469,673 | B2 | 10/2002 | Kaiponen |
| 6,473,056 | B2 | 10/2002 | Annamaa |
| 6,476,767 | B2 | 11/2002 | Aoyama et al. |
| 6,476,769 | B1 | 11/2002 | Lehtola |
| 6,480,155 | B1 | 11/2002 | Eggleston |
| 6,483,462 | B2 | 11/2002 | Weinberger |
| 6,498,586 | B2 | 12/2002 | Pankinaho |
| 6,501,425 | B1 | 12/2002 | Nagumo |
| 6,515,625 | B1 | 2/2003 | Johnson |
| 6,518,925 | B1 | 2/2003 | Annamaa |
| 6,529,168 | B2 | 3/2003 | Mikkola |
| 6,529,749 | B1 | 3/2003 | Hayes et al. |
| 6,535,170 | B2 | 3/2003 | Sawamura et al. |
| 6,538,604 | B1 | 3/2003 | Isohatala |
| 6,538,607 | B2 | 3/2003 | Barna |
| 6,542,050 | B1 | 4/2003 | Arai et al. |
| 6,549,167 | B1 | 4/2003 | Yoon |
| 6,552,686 | B2 | 4/2003 | Ollikainen et al. |
| 6,556,812 | B1 | 4/2003 | Pennanen et al. |
| 6,566,944 | B1 | 5/2003 | Pehlke |
| 6,580,396 | B2 | 6/2003 | Lin |
| 6,580,397 | B2 | 6/2003 | Lindell |
| 6,600,449 | B2 | 7/2003 | Onaka |
| 6,603,430 | B1 | 8/2003 | Hill et al. |
| 6,606,016 | B2 | 8/2003 | Takamine et al. |
| 6,611,235 | B2 | 8/2003 | Barna et al. |
| 6,614,400 | B2 | 9/2003 | Egorov |
| 6,614,401 | B2 | 9/2003 | Onaka et al. |
| 6,614,405 | B1 | 9/2003 | Mikkonen |
| 6,634,564 | B2 | 10/2003 | Kuramochi |
| 6,636,181 | B2 | 10/2003 | Asano |
| 6,639,564 | B2 | 10/2003 | Johnson |
| 6,646,606 | B2 | 11/2003 | Mikkola |
| 6,650,295 | B2 | 11/2003 | Ollikainen et al. |
| 6,657,593 | B2 | 12/2003 | Nagumo et al. |
| 6,657,595 | B1 | 12/2003 | Phillips et al. |
| 6,670,926 | B2 | 12/2003 | Miyasaka |
| 6,677,903 | B2 | 1/2004 | Wang |
| 6,680,705 | B2 | 1/2004 | Tan et al. |
| 6,683,573 | B2 | 1/2004 | Park |
| 6,693,594 | B2 | 2/2004 | Pankinaho et al. |
| 6,717,551 | B1 | 4/2004 | Desclos et al. |
| 6,727,857 | B2 | 4/2004 | Mikkola |
| 6,734,825 | B1 | 5/2004 | Guo et al. |
| 6,734,826 | B1 | 5/2004 | Dai et al. |
| 6,738,022 | B2 | 5/2004 | Klaavo et al. |
| 6,741,214 | B1 | 5/2004 | Kadambi et al. |
| 6,753,813 | B2 | 6/2004 | Kushihi |
| 6,759,989 | B2 | 7/2004 | Tarvas et al. |
| 6,765,536 | B2 | 7/2004 | Phillips et al. |
| 6,774,853 | B2 | 8/2004 | Wong et al. |
| 6,781,545 | B2 | 8/2004 | Sung |
| 6,801,166 | B2 | 10/2004 | Mikkola |
| 6,801,169 | B1 | 10/2004 | Chang et al. |
| 6,806,835 | B2 | 10/2004 | Iwai |
| 6,819,287 | B2 | 11/2004 | Sullivan et al. |
| 6,819,293 | B2 | 11/2004 | De Graauw |
| 6,825,818 | B2 | 11/2004 | Toncich |
| 6,836,249 | B2 | 12/2004 | Kenoun et al. |
| 6,847,329 | B2 | 1/2005 | Ikegaya et al. |
| 6,856,293 | B2 | 2/2005 | Bordi |
| 6,862,437 | B1 | 3/2005 | McNamara |
| 6,862,441 | B2 | 3/2005 | Ella |
| 6,873,291 | B2 | 3/2005 | Aoyama |
| 6,876,329 | B2 | 4/2005 | Milosavljevic |
| 6,882,317 | B2 | 4/2005 | Koskiniemi |
| 6,891,507 | B2 | 5/2005 | Kushihi et al. |
| 6,897,810 | B2 | 5/2005 | Dai et al. |
| 6,900,768 | B2 | 5/2005 | Iguchi et al. |
| 6,903,692 | B2 | 6/2005 | Kivekas |
| 6,906,678 | B2 * | 6/2005 | Chen ..... 343/795 |
| 6,911,945 | B2 | 6/2005 | Korva |
| 6,922,171 | B2 | 7/2005 | Annamaa |
| 6,925,689 | B2 | 8/2005 | Folkmar |
| 6,927,729 | B2 | 8/2005 | Legay |
| 6,937,196 | B2 | 8/2005 | Korva |
| 6,950,065 | B2 | 9/2005 | Ying et al. |
| 6,950,066 | B2 | 9/2005 | Hendler et al. |
| 6,950,068 | B2 | 9/2005 | Bordi |
| 6,950,072 | B2 | 9/2005 | Miyata et al. |
| 6,952,144 | B2 | 10/2005 | Javor |
| 6,952,187 | B2 | 10/2005 | Annamaa |
| 6,958,730 | B2 | 10/2005 | Nagumo et al. |
| 6,961,544 | B1 | 11/2005 | Hagstrom |
| 6,963,308 | B2 | 11/2005 | Korva |
| 6,963,310 | B2 | 11/2005 | Horita et al. |
| 6,967,618 | B2 | 11/2005 | Ojantakanen |
| 6,975,278 | B2 | 12/2005 | Song et al. |

(56) References Cited

U.S. PATENT DOCUMENTS

| | | | |
|---|---|---|---|
| 6,980,158 | B2 | 12/2005 | Iguchi et al. |
| 6,985,108 | B2 | 1/2006 | Mikkola |
| 6,992,543 | B2 | 1/2006 | Luetzelschwab et al. |
| 6,995,710 | B2 | 2/2006 | Sugimoto et al. |
| 7,023,341 | B2 | 4/2006 | Stilp |
| 7,031,744 | B2 | 4/2006 | Kuriyama et al. |
| 7,034,752 | B2 | 4/2006 | Sekiguchi et al. |
| 7,042,403 | B2 | 5/2006 | Colburn et al. |
| 7,053,841 | B2 | 5/2006 | Ponce De Leon et al. |
| 7,054,671 | B2 | 5/2006 | Kaiponen et al. |
| 7,057,560 | B2 | 6/2006 | Erkocevic |
| 7,061,430 | B2 | 6/2006 | Zheng et al. |
| 7,081,857 | B2 | 7/2006 | Kinnunen et al. |
| 7,084,831 | B2 | 8/2006 | Takagi et al. |
| 7,099,690 | B2 | 8/2006 | Milosavljevic |
| 7,113,133 | B2 | 9/2006 | Chen et al. |
| 7,119,749 | B2 | 10/2006 | Miyata et al. |
| 7,126,546 | B2 | 10/2006 | Annamaa |
| 7,129,893 | B2 | 10/2006 | Otaka et al. |
| 7,136,019 | B2 | 11/2006 | Mikkola |
| 7,136,020 | B2 | 11/2006 | Yamaki |
| 7,142,824 | B2 | 11/2006 | Kojima et al. |
| 7,148,847 | B2 | 12/2006 | Yuanzhu |
| 7,148,849 | B2 | 12/2006 | Lin |
| 7,148,851 | B2 | 12/2006 | Takaki et al. |
| 7,170,464 | B2 | 1/2007 | Tang et al. |
| 7,176,838 | B1 | 2/2007 | Kinezos |
| 7,180,455 | B2 | 2/2007 | Oh et al. |
| 7,193,574 | B2 | 3/2007 | Chiang et al. |
| 7,205,942 | B2 | 4/2007 | Wang et al. |
| 7,215,283 | B2 | 5/2007 | Boyle |
| 7,218,280 | B2 | 5/2007 | Annamaa |
| 7,218,282 | B2 | 5/2007 | Humpfer et al. |
| 7,224,313 | B2 | 5/2007 | McKinzie, III et al. |
| 7,230,574 | B2 | 6/2007 | Johnson |
| 7,233,775 | B2 | 6/2007 | De Graauw |
| 7,237,318 | B2 | 7/2007 | Annamaa |
| 7,256,743 | B2 | 8/2007 | Korva |
| 7,274,334 | B2 | 9/2007 | O'Riordan et al. |
| 7,283,097 | B2 | 10/2007 | Wen et al. |
| 7,289,064 | B2 | 10/2007 | Cheng |
| 7,292,200 | B2 | 11/2007 | Posluszny et al. |
| 7,319,432 | B2 | 1/2008 | Andersson |
| 7,330,153 | B2 | 2/2008 | Rentz |
| 7,333,067 | B2 | 2/2008 | Hung et al. |
| 7,339,528 | B2 | 3/2008 | Wang et al. |
| 7,340,286 | B2 | 3/2008 | Korva et al. |
| 7,345,634 | B2 | 3/2008 | Ozkar et al. |
| 7,352,326 | B2 | 4/2008 | Korva |
| 7,355,270 | B2 | 4/2008 | Hasebe et al. |
| 7,358,902 | B2 | 4/2008 | Erkocevic |
| 7,375,695 | B2 | 5/2008 | Ishizuka et al. |
| 7,381,774 | B2 | 6/2008 | Bish et al. |
| 7,382,319 | B2 | 6/2008 | Kawahata et al. |
| 7,385,556 | B2 | 6/2008 | Chung et al. |
| 7,388,543 | B2 | 6/2008 | Vance |
| 7,391,378 | B2 | 6/2008 | Mikkola et al. |
| 7,405,702 | B2 | 7/2008 | Annamaa et al. |
| 7,417,588 | B2 | 8/2008 | Castany et al. |
| 7,423,592 | B2 | 9/2008 | Pros et al. |
| 7,432,860 | B2 | 10/2008 | Huynh |
| 7,439,929 | B2 | 10/2008 | Ozkar |
| 7,443,344 | B2 | 10/2008 | Boyle |
| 7,468,700 | B2 | 12/2008 | Milosavlejevic |
| 7,468,709 | B2 | 12/2008 | Niemi et al. |
| 7,498,990 | B2 | 3/2009 | Park et al. |
| 7,501,983 | B2 | 3/2009 | Mikkola |
| 7,502,598 | B2 | 3/2009 | Kronberger |
| 7,589,678 | B2 | 9/2009 | Perunka et al. |
| 7,616,158 | B2 | 11/2009 | Mark et al. |
| 7,633,449 | B2 | 12/2009 | Oh |
| 7,663,551 | B2 | 2/2010 | Nissinen |
| 7,679,565 | B2 | 3/2010 | Sorvala |
| 7,692,543 | B2 | 4/2010 | Copeland |
| 7,710,325 | B2 | 5/2010 | Cheng |
| 7,724,204 | B2 | 5/2010 | Annamaa |
| 7,760,146 | B2 | 7/2010 | Ollikainen |
| 7,764,245 | B2 | 7/2010 | Loyet |
| 7,786,938 | B2 | 8/2010 | Sorvala |
| 7,800,544 | B2 | 9/2010 | Thornell-Pers |
| 7,830,327 | B2 | 11/2010 | He |
| 7,843,397 | B2 | 11/2010 | Boyle |
| 7,889,139 | B2 | 2/2011 | Hobson et al. |
| 7,889,143 | B2 | 2/2011 | Milosavljevic |
| 7,901,617 | B2 | 3/2011 | Taylor et al. |
| 7,903,035 | B2 | 3/2011 | Mikkola et al. |
| 7,916,086 | B2 | 3/2011 | Koskiniemi et al. |
| 7,963,347 | B2 | 6/2011 | Pabon |
| 7,973,720 | B2 | 7/2011 | Sorvala |
| 8,049,670 | B2 | 11/2011 | Jung et al. |
| 8,098,202 | B2 | 1/2012 | Annamaa et al. |
| 8,179,322 | B2 | 5/2012 | Nissinen |
| 8,193,998 | B2 | 6/2012 | Puente et al. |
| 8,378,892 | B2 | 2/2013 | Sorvala et al. |
| 8,466,756 | B2 | 6/2013 | Milosavljevic et al. |
| 8,473,017 | B2 | 6/2013 | Milosavljevic et al. |
| 8,564,485 | B2 | 10/2013 | Milosavljevic et al. |
| 8,629,813 | B2 | 1/2014 | Milosavljevic |
| 2001/0050636 | A1 | 12/2001 | Weinberger |
| 2002/0183013 | A1 | 12/2002 | Auckland et al. |
| 2002/0196192 | A1 | 12/2002 | Nagumo et al. |
| 2003/0146873 | A1 | 8/2003 | Blancho |
| 2004/0090378 | A1 | 5/2004 | Dai et al. |
| 2004/0137950 | A1 | 7/2004 | Bolin et al. |
| 2004/0145525 | A1 | 7/2004 | Annabi et al. |
| 2004/0171403 | A1 | 9/2004 | Mikkola |
| 2005/0057401 | A1 | 3/2005 | Yuanzhu |
| 2005/0159131 | A1 | 7/2005 | Shibagaki et al. |
| 2005/0176481 | A1 | 8/2005 | Jeong |
| 2006/0071857 | A1 | 4/2006 | Pelzer |
| 2006/0192723 | A1 | 8/2006 | Harada |
| 2007/0042615 | A1 | 2/2007 | Liao |
| 2007/0082789 | A1 | 4/2007 | Nissila |
| 2007/0152881 | A1 | 7/2007 | Chan |
| 2007/0188388 | A1 | 8/2007 | Feng |
| 2008/0055164 | A1 | 3/2008 | Zhang et al. |
| 2008/0059106 | A1 | 3/2008 | Wight |
| 2008/0088511 | A1 | 4/2008 | Sorvala |
| 2008/0266199 | A1 | 10/2008 | Milosavljevic |
| 2009/0009415 | A1 | 1/2009 | Tanska |
| 2009/0128425 | A1* | 5/2009 | Kim et al. ..... 343/702 |
| 2009/0135066 | A1 | 5/2009 | Raappana et al. |
| 2009/0174604 | A1 | 7/2009 | Keskitalo |
| 2009/0196160 | A1 | 8/2009 | Crombach |
| 2009/0197654 | A1 | 8/2009 | Teshima |
| 2009/0231213 | A1 | 9/2009 | Ishimiya |
| 2010/0220016 | A1 | 9/2010 | Nissinen |
| 2010/0220022 | A1* | 9/2010 | Yoon et al. ..... 343/727 |
| 2010/0244978 | A1 | 9/2010 | Milosavljevic |
| 2010/0309092 | A1 | 12/2010 | Lambacka |
| 2011/0012790 | A1* | 1/2011 | Badaruzzaman et al. ..... 343/700 MS |
| 2011/0109514 | A1* | 5/2011 | Galeev ..... 343/702 |
| 2011/0133994 | A1 | 6/2011 | Korva |
| 2011/0156958 | A1* | 6/2011 | Wong et al. ..... 343/700 MS |
| 2012/0119955 | A1 | 5/2012 | Milosavljevic et al. |
| 2012/0194404 | A1* | 8/2012 | Arkko et al. ..... 343/867 |
| 2012/0218151 | A1* | 8/2012 | Wong et al. ..... 343/700 MS |

FOREIGN PATENT DOCUMENTS

| | | |
|---|---|---|
| DE | 10150149 | 4/2003 |
| EP | 0 208 424 | 1/1987 |
| EP | 0 376 643 | 4/1990 |
| EP | 0 751 043 | 4/1997 |
| EP | 0 807 988 | 11/1997 |
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |

(56) References Cited

FOREIGN PATENT DOCUMENTS

| | | | | |
|---|---|---|---|---|
| EP | 1 361 623 | | 11/2003 | |
| EP | 1 406 345 | | 4/2004 | |
| EP | 1 453 137 | | 9/2004 | |
| EP | 1 220 456 | | 10/2004 | |
| EP | 1 467 456 | | 10/2004 | |
| EP | 1 753 079 | | 2/2007 | |
| FI | 20020829 | | 11/2003 | |
| FI | 118782 | | 3/2008 | |
| FR | 2553584 | | 10/1983 | |
| FR | 2724274 | | 3/1996 | |
| FR | 2873247 | | 1/2006 | |
| GB | 2266997 | | 11/1993 | |
| GB | 2360422 | | 9/2001 | |
| GB | 2389246 | | 12/2003 | |
| JP | 59-202831 | | 11/1984 | |
| JP | 60-206304 | | 10/1985 | |
| JP | 61-245704 | | 11/1986 | |
| JP | 06-152463 | | 5/1994 | |
| JP | 07-131234 | | 5/1995 | |
| JP | 07-221536 | | 8/1995 | |
| JP | 07-249923 | | 9/1995 | |
| JP | 07-307612 | | 11/1995 | |
| JP | 08-216571 | | 8/1996 | |
| JP | 09-083242 | | 3/1997 | |
| JP | 09-260934 | | 10/1997 | |
| JP | 09-307344 | | 11/1997 | |
| JP | 10-028013 | | 1/1998 | |
| JP | 10-107671 | | 4/1998 | |
| JP | 10-173423 | | 6/1998 | |
| JP | 10-209733 | | 8/1998 | |
| JP | 10-224142 | | 8/1998 | |
| JP | 10-322124 | | 12/1998 | |
| JP | 10-327011 | | 12/1998 | |
| JP | 11-004113 | | 1/1999 | |
| JP | 11-004117 | | 1/1999 | |
| JP | 11-068456 | | 3/1999 | |
| JP | 11-127010 | | 5/1999 | |
| JP | 11-127014 | | 5/1999 | |
| JP | 11-136025 | | 5/1999 | |
| JP | 11-355033 | | 12/1999 | |
| JP | 2000-278028 | | 10/2000 | |
| JP | 2001-053543 | | 2/2001 | |
| JP | 2001-267833 | | 9/2001 | |
| JP | 2001-217631 | | 10/2001 | |
| JP | 2001-326513 | | 11/2001 | |
| JP | 2002-319811 | | 10/2002 | |
| JP | 2002-329541 | | 11/2002 | |
| JP | 2002-335117 | | 11/2002 | |
| JP | 2003-060417 | | 2/2003 | |
| JP | 2003-124730 | | 4/2003 | |
| JP | 2003-179426 | | 6/2003 | |
| JP | 2004-112028 | | 4/2004 | |
| JP | 2004-363859 | | 12/2004 | |
| JP | 2005-005985 | | 1/2005 | |
| JP | 2005-252661 | | 9/2005 | |
| KR | 20010080521 | | 10/2001 | |
| KR | 20020096016 | | 12/2002 | |
| KR | 100986702 | * | 10/2010 | ..... H01Q 13/08 |
| SE | 511900 | | 12/1999 | |
| TW | 20090146591 | * | 7/2011 | ..... H01Q 1/24 |
| WO | WO 92/00635 | | 1/1992 | |
| WO | WO 96/27219 | | 9/1996 | |
| WO | WO 98/01919 | | 1/1998 | |
| WO | WO 99/30479 | | 6/1999 | |
| WO | WO 01/20718 | | 3/2001 | |
| WO | WO 01/29927 | | 4/2001 | |
| WO | WO 01/33665 | | 5/2001 | |
| WO | WO 01/61781 | | 8/2001 | |
| WO | WO 2004/017462 | | 2/2004 | |
| WO | WO 2004/057697 | | 7/2004 | |
| WO | WO 2004/100313 | | 11/2004 | |
| WO | WO 2004/112189 | | 12/2004 | |
| WO | WO 2005/062416 | | 7/2005 | |
| WO | WO 2007/012697 | | 2/2007 | |
| WO | WO 2010/122220 | | 10/2010 | |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al, Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng- Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.

Hossa, R., A. Byndas, and M. E. Bialkowski, "Improvement of compact terminal antenna performance by incorporating open-end slots in ground plane," IEEE Microwave and Wireless Components Letters, vol. 14, 283-285, 2004.

I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.

International Preliminary Report on Patentability for International Application No. PCT/F12004/000554, date of issuance of report May 1, 2006.

Jing, X., et al; "Compact Planar Monopole Antenna for Multi-Band Mobile Phones"; Microwave Conference Proceedings, 4.-7.12.2005. APMC 2005, Asia- Pacific Conference Proceedings, vol. 4.

Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.

Kim, Kihong et al., "Integrated Dipole Antennas on Silicon Substrates for Intra-Chip Communication", IEEE, pp. 1582-1585, 1999.

Kivekas., O., J. Ollikainen, T. Lehtiniemi, and P. Vainikainen, "Bandwidth, SAR, and eciency of internal mobile phone antennas," *Transactions on Electromagnetic Compatibility*, vol. 46, 71{86,2004.

K-L Wong, *Planar Antennas for Wireless Communications*, Hoboken, NJ: Willey, 2003, ch. 2.

(56) References Cited

OTHER PUBLICATIONS

Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp*. Lett., vol. 14, No. 4, pp. 148-150, Apr. 2004.
P. Salonen, et al. "New slot configurations for dual-band planar inverted-F antenna," *Microwave Opt. Technol*., vol. 28, pp. 293-298, 2001.
Papapolymerou, loannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig*., pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, Iit Bombay, Nov. 2003, pp. 1-24.
Gobien, Andrew, T. "Investigation of Low Profile Antenna Designs for Use in Hand-Held Radios,"Ch.3, The Inverted-L Antenna and Variations; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for Wlan Applications," Dept. Of Electrical Engineering, National Sun Yat-Sen University, 2002 09 Ansoft Workshop, pp. 1-45.
"μ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No, 12177740.3.

* cited by examiner

MULTI-BAND ANTENNA AND METHODS FOR LONG TERM EVOLUTION WIRELESS SYSTEM

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to antenna apparatus for use within electronic devices such as wireless radio devices, and more particularly in one exemplary aspect to a multi-band long term evolution (LTE) antenna, and methods of tuning and utilizing the same.

DESCRIPTION OF RELATED TECHNOLOGY

Increased proliferation of long term evolution and long term evolution advanced (hereinafter collectively "LTE") mobile data services creates an increased demand for compact multi-band antennas typically used in radio devices, such as wireless access point, bridge, or a hub. Typically, it is desired for an LTE-compliant radio device to support operation in multiple frequency bands (such as, for example, 698 MHz to 960 MHz, 1710 MHz to 1990 MHz, 2110 MHz to 2170 MHz, and 2500 MHz to 2700 MHz). Furthermore, LTE system has been defined to accommodate paired spectrum for Frequency Division Duplex (FDD) mode of operation where the uplink and the downlink transmissions occupy different parts of the spectrum. By way of example, the uplink occupies the frequency range from 1710 MHz to 1770 MHz, and the downlink occupies the frequency range from 2110 MHz to 2170 MHz. It is therefore desirable for antennas used in an LTE-compliant device to cover a wide range of frequencies ranging from about 650 MHz to about 2700 MHz, while maintaining a unidirectional radiation pattern. It is further desired to be able to tune individual operating frequency bands of the antenna without affecting antenna functionality in other bands.

Dipole type antennas are typically used to achieve an omnidirectional radiation pattern, such as characterized by radiation pattern that is shaped like a toroid in three-dimensional space and is symmetric about the axis of the dipole.

However, most existing single feed dipole antenna solutions operate in a single frequency band. At present, implementing a single planar dipole antenna that is efficient in several frequency bands is problematic, as separate antenna elements that cover different frequency bands interact with each other and create mutual interference patterns that degrade antenna performance. Some existing approaches attempt to solve this problem by constructing multiple separately fed dipole antennas, each cooperating in a separate frequency band. Multiple dipole antennas (packaged within the same protective enclosure, also referred to as the radome) are often used to achieve multiband operation. However, such solutions require a separate feed for each antenna thereby increasing cost and complexity. This approach may also cause coupled resonances that adversely affect antenna performance.

Accordingly, there is a salient need for an improved multiband dipole antenna solution suitable for use in, inter alia, LTE compliant radio devices, that offers a lower cost and complexity, and provides for improved control of antenna resonance. Such improved solution would also ideally have a desirable form factor (e.g., small size, and compatible with target applications such as hand-held mobile devices).

SUMMARY OF THE INVENTION

The present invention satisfies the foregoing needs by providing, inter alia, a space-efficient multiband antenna apparatus, and methods of tuning and use.

In a first aspect of the invention, an antenna apparatus operable in a first frequency band and a second frequency band is disclosed. In one embodiment, the antenna apparatus includes a dielectric element comprising a first side and a second side, a feed point disposed on the first side, and a ground point disposed on the second side, a first structure operable in the first frequency band and disposed substantially on the first side, a second structure operable in the first frequency band and disposed substantially on the second side, a third structure operable in the second frequency band and disposed substantially on the first side, and a fourth structure operable in the second frequency band and disposed substantially on the second side. In one variant, the first structure is galvanically coupled to the feed point, the second structure is galvanically coupled to the ground point, the third structure is configured to electromagnetically couple to the first structure, and the fourth structure is configured to electromagnetically coupled to the second structure.

In another variant, the first structure includes a first radiator arm disposed substantially co-planar yet parallel to a second radiator arm and the second structure includes a third radiator arm disposed substantially co-planar yet parallel to a fourth radiator arm, the first radiator arm and the second radiator arm each comprise a linear slot disposed substantially longitudinally within the respective aim, and the apparatus includes a first substantially linear conductive element disposed on the first side and configured to couple the feed point to the first and the second radiator arms via a first T-junction, and a second substantially linear conductive element disposed on the second side and configured to couple the feed point to the third and the fourth radiator arms via a second T-junction.

In another variant, the antenna apparatus includes a first conductive element disposed between the first structure and the feed point and effecting the galvanic coupling to the feed point, a first electromagnetic coupling element electrically disposed between the first conductive element and a first branch of the third structure, and a second electromagnetic coupling element electrically disposed between the first conductive element and a second branch of the third structure, so that the first electromagnetic coupling element is configured to electromagnetically couple the first branch of the third structure to the feed point, and the second electromagnetic coupling element is configured to electromagnetically couple the second branch of the third structure to the feed point.

In yet another variant, the antenna apparatus includes a second conductive element disposed between at least a portion of the second structure and the ground point and effecting the galvanic coupling to the ground point, a third electromagnetic coupling element electrically disposed between at least a portion of the second conductive element and a first branch of the fourth structure, and a fourth electromagnetic coupling element electrically disposed between at least a portion of the second conductive element and a second branch of the fourth structure, the third electromagnetic coupling element is configured to electromagnetically couple the first branch of the fourth structure to the ground point, and the fourth electromagnetic coupling element is configured to electromagnetically couple the second branch of the fourth structure to the ground point.

In still another variant, the antenna apparatus includes a structure disposed substantially on the first side and configured to electrically couple to the second conductive element, so that electric coupling of the structure to the second conductive element is effected via a conductor configured to penetrate through the dielectric element in a direction normal to the first side.

In another variant, the first structure and the second structure are configured to cooperate to form at least a portion of a first dipole antenna operable in the first frequency band, and the third structure and the fourth structure are configured to cooperate to form at least a portion of a second dipole antenna operable in the second frequency band so that the antenna apparatus is characterized by a substantially omni-directional radiation pattern in at least one of the first frequency band and the second frequency band in a plane substantially normal to the element, and the first frequency band includes a lower frequency long term evolution (LTE) application band, and the second frequency band includes an upper frequency LTE application band.

In another aspect of the invention, a multiband antenna component for use with a radio communications device, the device operable in a first frequency band and a second frequency band is disclosed. In one embodiment, the antenna component includes a dielectric element comprising a first side and a second side, a first structure operable in the first frequency band and disposed substantially on the first side, a second structure operable in the first frequency band and disposed substantially on the second side, the first structure is connected to a feed disposed on the first side, and the second structure is connected to a coupling.

In one variant, antenna component includes a third structure operable in the second frequency band and disposed substantially on the first side, and a fourth structure operable in the second frequency band and disposed substantially on the second side, the third structure is configured to electromagnetically couple to the first structure, the fourth structure is configured to electromagnetically couple to the second structure, the first frequency band includes a lower frequency long term evolution (LTE) application band and second frequency band is selected from a group consisting of (i) 1710-1990 MHz, (ii) 2110-2170 MHz; and 2500-2700 MHz long term evolution (LIE) application frequency bands.

In another variant, the first structure includes a first radiator arm disposed substantially co-planar yet parallel to a second radiator arm, the first radiator arm includes a first linear slot disposed substantially longitudinally within the first radiator arm, the second structure includes a third radiator arm disposed substantially co-planar yet parallel to a fourth radiator arm, and the second radiator arm includes a second linear slot disposed substantially longitudinally within the second radiator arm, a first conductive element disposed between the first structure and the feed and effecting the connection of the first structure to the feed.

In another variant, the antenna component includes a first electromagnetic coupling element electrically disposed between the first conductive element and a first branch of the third structure, and a second electromagnetic coupling element electrically disposed between the first conductive element and a second branch of the third structure, the first electromagnetic coupling element is configured to electromagnetically couple the first radiator arm to the feed point, and the second electromagnetic coupling element is configured to electromagnetically couple the second radiator arm to the feed.

In yet another variant, the antenna component includes a first conductive element disposed on the first side and configured to effect the connection between the feed and the first structure, a second conductive element disposed on the second side and configured to effect the connection between the coupling and the second structure, and a structure disposed substantially on the first side and configured to electrically couple to the second conductive element.

In still another variant, outer perimeter of the first structure is configured substantially external to outer perimeter of the second structure, outer perimeter of the third structure is configured substantially external to outer perimeter of the fourth structure, outer perimeter of the first structure is configured to overlap at least partially outer perimeter of the third structure when viewed in a direction substantially normal to the first side, and outer perimeter of the second structure is configured to overlap at least partially outer perimeter of the fourth structure when viewed in the direction substantially normal to the first side.

In a third aspect of the invention, a method of operating an antenna apparatus is disclosed. In one embodiment, the method comprises providing a feed signal to both a feed disposed on a first side of a dielectric substrate, and to a coupling disposed on the second side of the dielectric substrate; exciting a first antenna structure disposed substantially on the first side and electrically coupled to the feed point so as to radiate in a first frequency band; and exciting a second antenna structure disposed substantially on the second side so as to radiate in the first frequency band.

In a fourth aspect of the invention, a method of tuning an antenna apparatus is disclosed. In one embodiment, the method comprises providing a feed signal to both a feed disposed on a first side of a dielectric substrate, and to a coupling disposed on the second side of the dielectric substrate; exciting a first antenna structure disposed substantially on the first side and electrically coupled to the feed so as to radiate in a first frequency band, and exciting a second antenna structure disposed substantially on the second side so as to radiate in the first frequency band, and tuning an electromagnetic coupling of a third antenna structure and the first antenna structure in a second frequency band. In one variant, the electromagnetic coupling of the third antenna structure and the first antenna structure is effected by a first linear slot disposed substantially longitudinally within a first radiator arm, and a second linear slot disposed substantially longitudinally within a second radiator arm.

In a fifth aspect of the invention, a method of operating a mobile device is disclosed. In one embodiment, the method comprises providing a feed signal to both an antenna feed disposed on a first side of a dielectric substrate, and to an antenna coupling disposed on the second side of the dielectric substrate; exciting a first antenna structure disposed substantially on the first side and electrically coupled to the feed so as to radiate in the first frequency band; and exciting a second antenna structure disposed substantially on the second side to radiate in the first frequency band.

Further features of the present invention, its nature and various advantages will be more apparent from the accompanying drawings and the following detailed description.

BRIEF DESCRIPTION OF THE DRAWINGS

The features, objectives, and advantages of the invention will become more apparent from the detailed description set forth below when taken in conjunction with the drawings, wherein:

FIGS. 6-1 through 6-11 are plots of measured elevation-plane radiation pattern ((x, z), $\phi$=0 deg.) of the exemplary multiband dipole antenna configured in accordance with the embodiment of FIG. 1B, obtained at different frequencies of (i) 698 MHz; (ii) 859 MHz; (iii) 960 MHz, (iv) 1710 MHz, (v) 1860 MHz, (vi) 1980 MHz, (vii) 2110 MHz, (viii) 2170 MHz, (ix) 2500 MHz, (x) 2600 MHz, and (xi) 2700 MHz, respectively.

FIGS. 7-1 through 7-10 are plots of measured elevation-plane ((y, z), $\phi$=90 deg.) radiation pattern of the exemplary multiband dipole antenna configured in accordance with the embodiment of FIG. 1B, obtained at different frequencies of (i) 698 MHz; (ii) 859 MHz; (iii) 960 MHz, (iv) 1710 MHz, (v) 1860 MHz, (vi) 1980 MHz, (vii) 2110 MHz, (viii) 2170 MHz, (ix) 2500 MHz, and (x) 2600 MHz, respectively.

FIGS. 8-1 through 8-11 are plots of measured azimuth-plane (x, y) radiation pattern of the exemplary multiband dipole antenna configured in accordance with the embodiment of FIG. 1B, obtained at different frequencies of (i) 698 MHz; (ii) 859 MHz; (iii) 960 MHz, (iv) 1710 MHz, (v) 1860 MHz, (vi) 1980 MHz, (vii) 2110 MHz, (viii) 2170 MHz, (ix) 2500 MHz, (x) 2600 MHz, and (xi) 2700 MHz, respectively.

Figure 1:
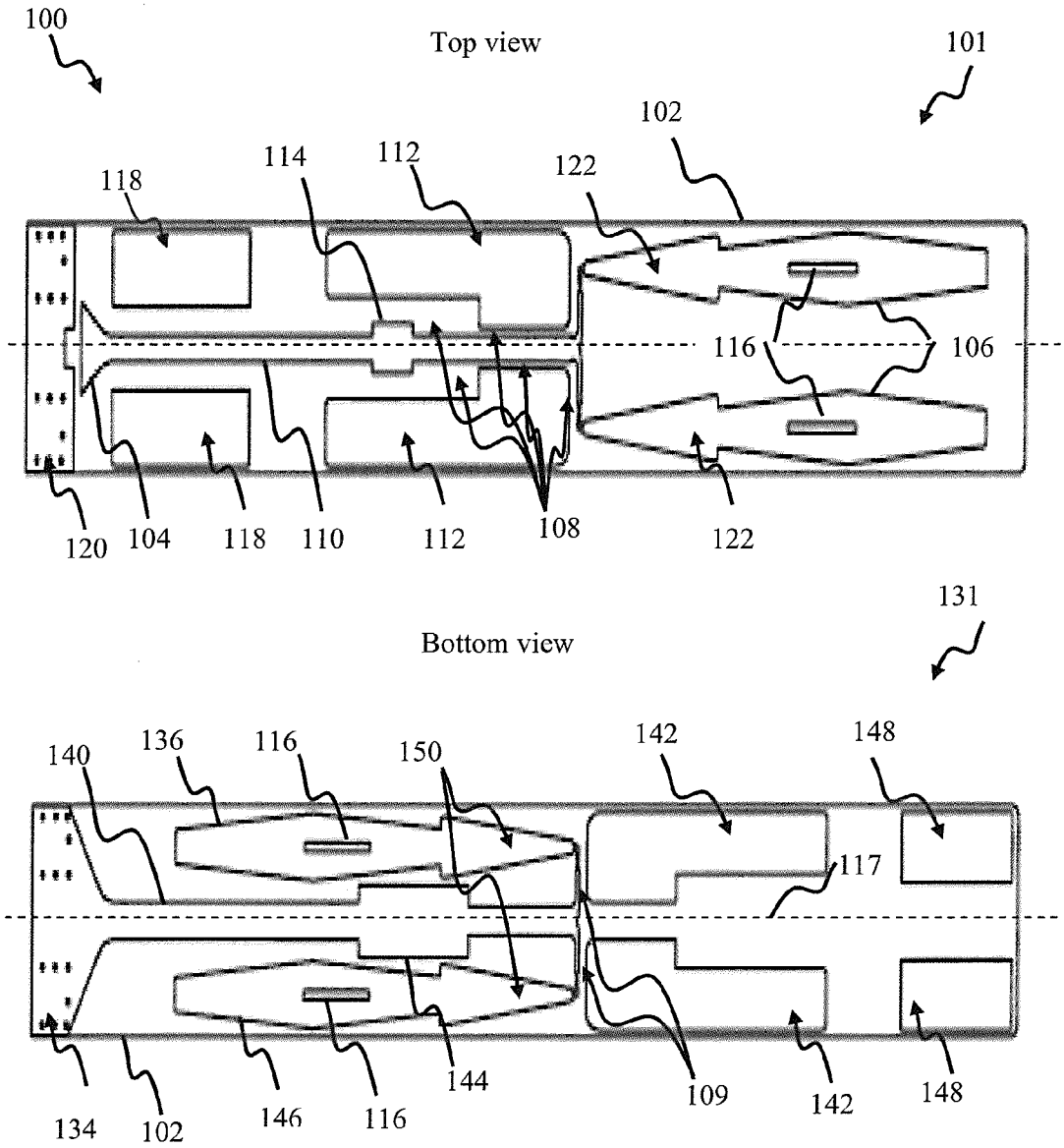
FIG. 1 illustrates top and bottom elevation views of a multiband dipole antenna structure according to a first embodiment of the invention.

All Figures disclosed herein are © Copyright 2011 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "access point," "wireless hub," "wireless bridge", 'wireless station", and "corporate access point" refer without limitation to any wireless radio device capable of exchanging data via a radio link.

As used herein, the terms "antenna," "antenna system," "antenna assembly", and "multi-band antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile computing device", "client device", "portable computing device", and "end user device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna or portion thereof.

The terms "RF feed," "feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems such as GPS, millimeter wave or microwave systems, optical, acoustic, and infrared (i.e., IrDA).

Overview

The present invention provides, in one salient aspect, a multi-band dipole antenna apparatus for use with a radio device which advantageously provides reduced size and cost, and improved antenna performance. In one embodiment, the antenna apparatus includes two separate antenna assemblies disposed on the opposing sides of a thin dielectric element.

Each antenna assembly of the exemplary embodiment is adapted for use in LTE devices, and includes a first radiator structure configured to operate in a lower frequency band (LFB), a second radiator structure configured to operate in an upper frequency band (UFB), and an electromagnetic coupling element disposed there between. The first radiator structure is configured such that a higher-order resonance mode optimizes upper frequency band operation. The first radiator structure is galvanically coupled to a feed port of the radio device via a transmission line element. The second radiator structure is electromagnetically coupled to the feed via the electromagnetic coupling element, also commonly referred to as the parasitic coupling. The two antenna assemblies are configured in an opposing fashion such that the LFB radiator of the top antenna is positioned above the UFB radiator of the bottom antenna and the UFB radiator of the top antenna is positioned above the LFB radiator of the bottom antenna. Such radiator configuration enables the UFB structure of each antenna assembly (for example, on the top side) to couple to the LFB structure of the opposing antenna assembly (for example, on the bottom side) via electric field coupling at a resonance frequency across the dielectric substrate thickness.

The transmission line of each antenna assembly includes, in one implementation, a linear microstrip element featuring a tuning flap structure that may be disposed at different locations along the length of the transmission line. Such configuration improves antenna feed efficiency and optimizes antenna resonance.

In order to obtain dipole radiation pattern, each of the LFB and UFB radiator structures of the exemplary embodiment includes a pair of radiating arms, disposed symmetrically with respect to a longitudinal axis of the dielectric element and parallel with respect to one another. In one variant, the UFB arms are configured as elongated rhomboids and UFB arms are configured as elongated rectangular or elliptical elements. Such two planar blade dipole antenna assemblies provide a combined omni-directional radiation pattern in the azimuthal plane for each of the lower and upper frequency bands. A linear slot (disposed axially within the LFB arm, in one implementation, is configured to improve HFB coupling.

A single multi-feed transceiver is configured to provide feed signal to both antenna assemblies. In one approach, the feed is effected via a coaxial cable which is coupled to a top side of the antenna apparatus. The antenna coupling structure (in one implementation) includes a set of conductors galvanically coupling the top side coupling point to the bottom side coupling point in order to provide feed to the second antenna assembly.

DETAILED DESCRIPTION OF EXEMPLARY EMBODIMENTS

Detailed descriptions of the various embodiments and variants of the apparatus and methods of the invention are now provided. While primarily discussed in the context of the access point radio devices useful with an LTE wireless communications device or system, the various apparatus and methodologies discussed herein are not so limited. In fact, many of the apparatus and methodologies described herein are useful in any number of complex antennas, whether associated with mobile or fixed devices, cellular or otherwise, that can benefit from the multiband dipole antenna methodologies and apparatus described herein.

Exemplary Antenna Apparatus

Figure 1A:
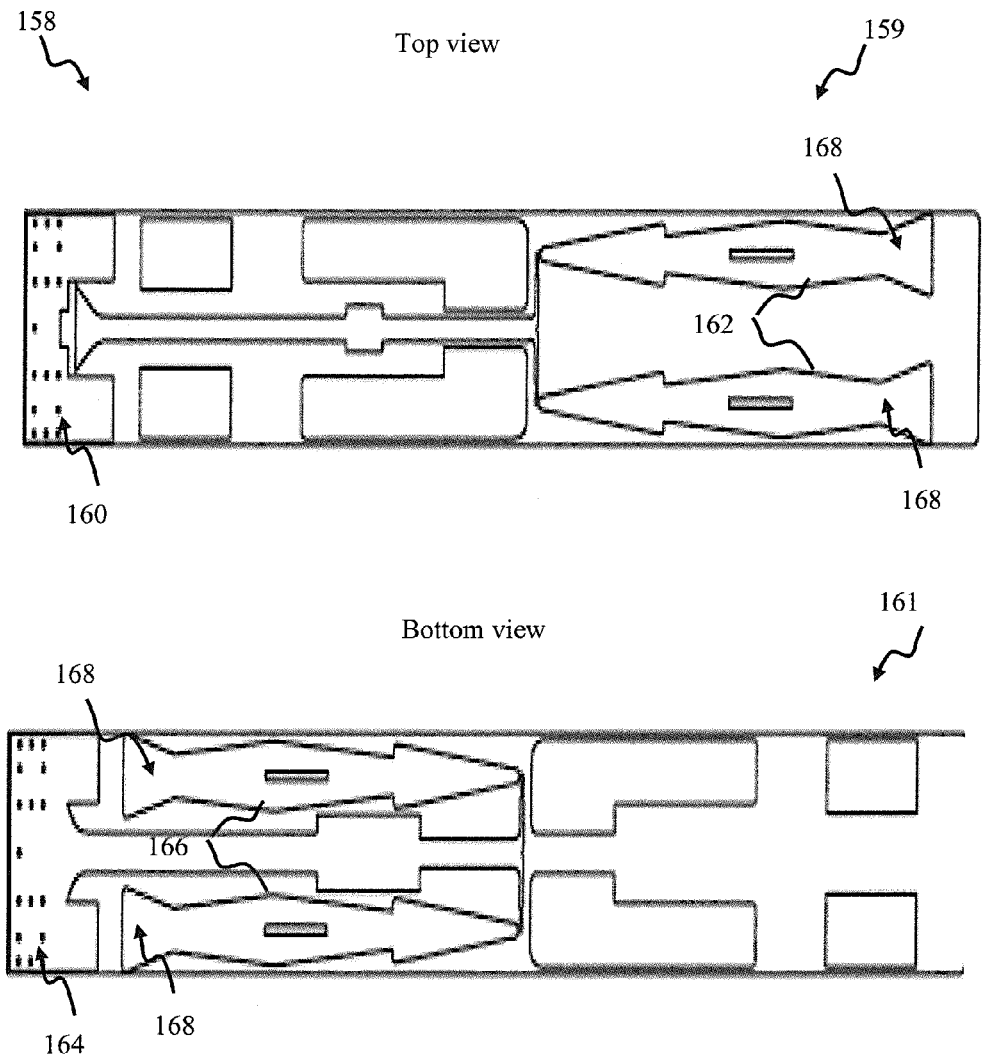
FIG. 1A illustrates top and bottom elevation views of a multiband dipole antenna structure according to a second embodiment of the invention.
Figure 1B:
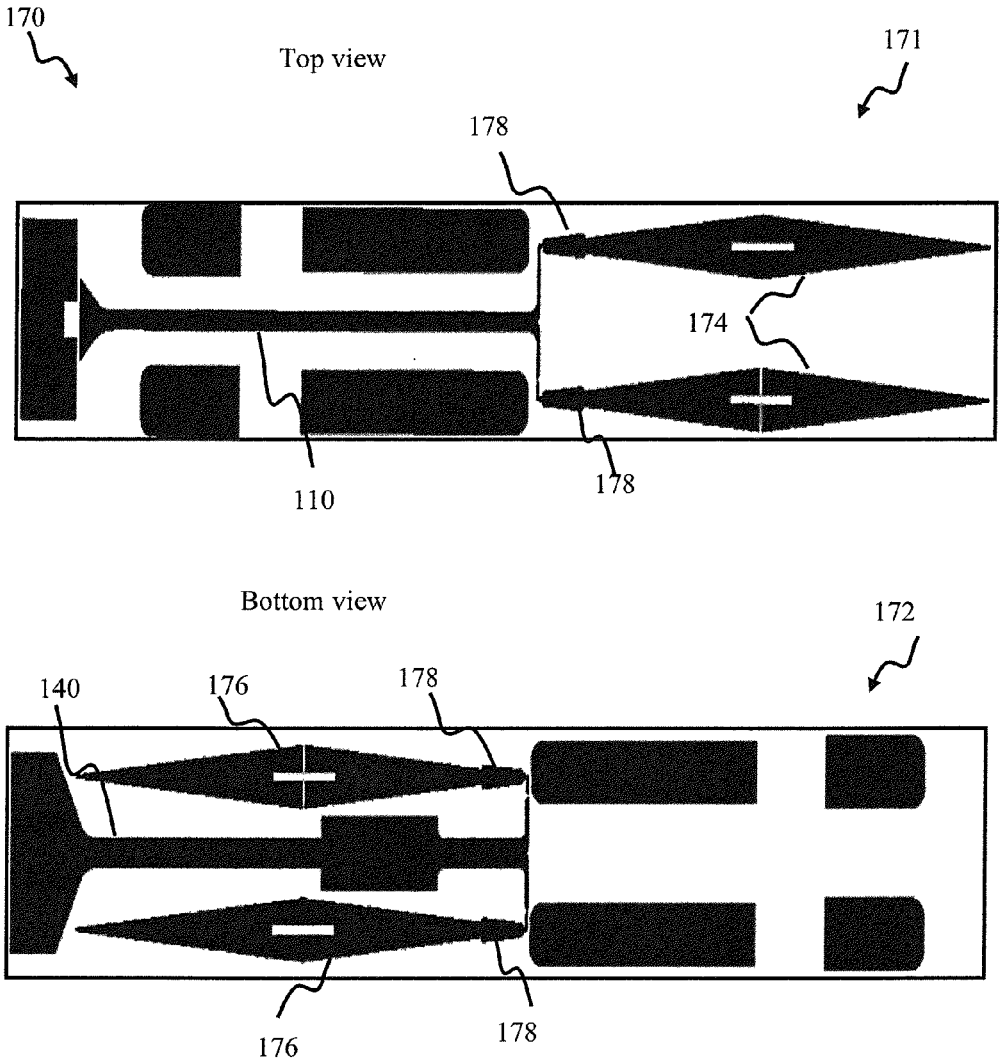
FIG. 1B illustrates top and bottom elevation views of a multiband dipole antenna structure according to a third embodiment of the invention.
Figure 1C:
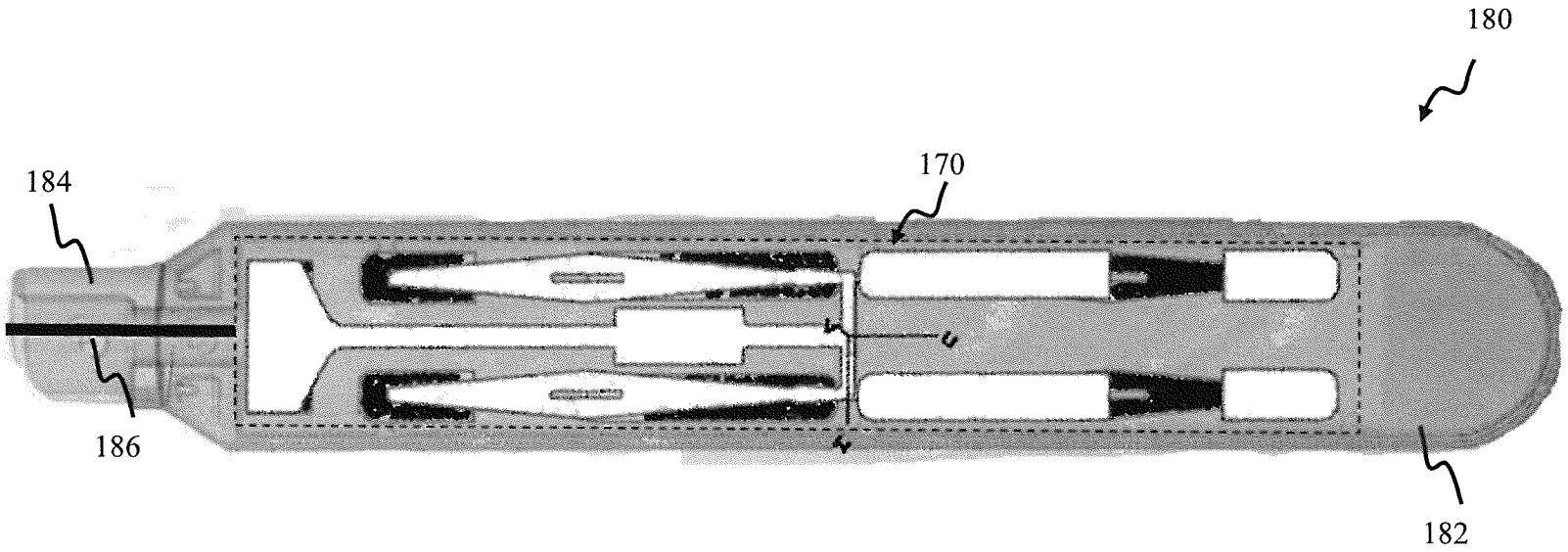
FIG. 1C is a top elevation view showing a multiband dipole antenna of FIG. 1B, configured in a radome according to one embodiment of the invention.

Referring now to FIGS. 1 through 1C, various exemplary embodiments of the radio antenna apparatus of the invention are described in detail.

It will be appreciated that while these exemplary embodiments of the antenna apparatus of the invention are implemented using a blade dipole (using two surface of a planar substrate) antenna (selected in these embodiments for their desirable attributes and performance), the invention is in no way limited to planar antenna configuration, and in fact can be implemented using other shapes, such as, for example, a three-dimensional (3D) cylinder or a truncated cone.

One exemplary embodiment of a multiband antenna component 100 for use with a radio device is presented in FIG. 1, showing top and bottom elevation views of the antenna structure. The antenna component shown in FIG. 1 includes a planar dielectric element 102 fabricated from a suitable material such as 4000-series high frequency circuit laminate manufactured by Rogers Corporation, although it will be appreciated that other materials may be used. The antenna 100 further includes two antenna sub-assemblies 101, 131 disposed on the top and the bottom side of the dielectric element 102, respectively. In another embodiment (not shown), the antenna structure is fabricated using a flex circuit.

The top antenna sub-assembly 101 includes a low frequency band (LFB) structure comprised of two symmetric arms 106, each coupled to a feed 104 (here a point) via a linear transmission line element 110, implemented as a microstrip in one variant. In another variant, a flap 114 is added to the transmission line in order to enable precise manipulation of antenna resonances, and to improve feed coupling. In one approach, the flap 114 includes a rectangular perimeter, while other shapes (such as rhomboid, circle or an ellipse) are equally compatible and useful with the invention. Furthermore, positioning the flap 114 at different locations along the transmission line 110 allows for optimization of antenna operation in different LF and HF bands.

The feed 104 and the ground 120 coupling points are configured to connect the antenna component 100 via a feed cable to the device feed engine. In one implementation, the feed cable includes a coaxial cable with a shield, and is connected to the radio device via an RF connector. Other 50 ohm RF transmission line configurations, e.g., SMA connector, flex circuit, etc. are usable as well. The feed conductor of the coaxial feed cable connects the antenna feed point 104 to the RF engine feed port, and the shield conductor is connected to the antenna ground coupling point 120. The antenna ground coupling structure includes the top ground point 120 connected to the bottom ground structure 134 through, for example, via holes that provide galvanic contact between the two ground structures (120, 134), therefore coupling the structure 134 to the feed cable ground conductor.

The bottom antenna sub-assembly 131 similarly includes a low frequency band structure comprised of two symmetric arms 136, each coupled to the ground structure 134 via the transmission line element 140. In one variant, a flap 144 is added to the transmission line 140 in order to enable precise manipulation of antenna resonances, and to improve feed coupling. In one approach, the flap 114 comprises a rectangular perimeter, while other shapes (such as rhomboid, circle or an ellipse) are equally compatible and useful with the invention. Furthermore, positioning the flap 114 at different locations along the transmission line 110 allows for optimization of antenna operation in different LF and HF bands.

Each of the top and the bottom antenna sub-assemblies 101, 131 comprises a high frequency band (HFB) radiating structure comprising a pair of arms 112, 142, respectively. The arms 112 are disposed symmetrically with respect to the transmission line 110 while the arms 142 are disposed substantially symmetrically with respect to the longitudinal axis 117 of the antenna assembly. The HFB arms 112 are electromagnetically coupled to the feed via nonconductive gaps 108, formed between the adjacent edges of the HFB arms 112 and the transmission line 110 (and its "T" junction portion). The gaps 108 act as electromagnetic coupling elements, providing capacitive coupling between the transmission line and the HFB arms, and enabling energy transfer from the feed.

Similarly, the HFB arms 142 are electromagnetically coupled to the feed via nonconductive gaps 109 formed between the adjacent edges of the HFB arms 142 and the T-junction portion of the transmission line 110. The gaps 109 act as electromagnetic coupling (also referred to as the parasitic coupling) elements, enabling higher-order mode resonances in the HFB arms. The configuration shown in FIG. 1 causes the lower band feed (for example, in the frequency range between 700 MHz and 960 MHz) to generate second-order resonance modes in the HFB arms, thereby facilitating antenna operation in a higher frequency range (for example, between 1710 and 2170 MHz). Note, although the second harmonic for an ideal (properly matched) single frequency oscillator of 960 MHz corresponds to 1920 MHz, the wide span of the low frequency range (700-960 MHz) enables efficient antenna operation at frequencies of up to 2170 MHz in the HFB.

As shown and described with respect to FIG. 1, the LFB 106, 142 and the HFB 112, 136 radiating structures are disposed opposing each other on the top 101 and the bottom 131 antenna sub-assemblies, respectively. That is, the LFB structure 106 is disposed above the HFB structure 142, while the HFB structure 112 is disposed above the LFB structure 136. This "head-to-toe" configuration further enables coupling of the HFB structures 112, 142 to the respective LFB structures 106, 136, respectively, via electric field at the resonance across the thickness of the dielectric substrate 102. The electromagnetic and electric field coupling described above is also commonly referred to as "parasitic coupling", and the antenna elements that are fed in such manner are commonly referred to as "parasitics".

Each of the LFB arms 106, 136 of the antenna embodiment of FIG. 1 comprises a linear slot 116 disposed axially proximate the center axis of the respective arm, so as to improve electromagnetic coupling efficiency of the respective HFB arm (that is the arms 142, 112, respectively) disposed underneath the LFB arms 106, 146.

In the embodiment of FIG. 1, In order to increase antenna bandwidth, the antenna sub-assemblies 101, 131 comprise a second set of lower band parasitically coupled radiator arms 118, 148 configured opposite from the LFB respective structures. That is, the parasitic LFB structure 118 of the top sub-assembly 101 is disposed above the LFB structure 136 of the bottom sub-assembly 131, and the parasitic LFB structure 148 of the bottom sub-assembly 131 is disposed above the LFB structure 106 of the top sub-assembly 101, respectively. Such antenna sub-assembly configuration causes electromagnetic coupling between the parasitic LFB structures 118, 148 and the directly-fed LFB structures 106, 136, respectively, thereby enabling antenna matching over a wider frequency band. This approach advantageously increases useful frequency range of the antenna apparatus shown in FIG. 1, and enables radio device operation in additional frequency bands (e.g., LTE bands).

The exact location and the shapes of each of the structures 106, 112, 118, 136, 142, 148 are configured with regard to a specific design requirements such as available space, bandwidth, efficiency, radiation pattern, and power. The exemplary antenna of the embodiment presented in FIG. 1 is configured to operate in the following long-term evolution (LTE)/LTE-A system frequency bands of approximately 698-960 MHz, 1710-1990 MHz, 2110-2170 MHz, and 2500-2700 MHz. In the antenna variant shown in FIG. 1, the exemplary antenna is approximately 165 mm (6.56 inch) in length, 28 mm (1.1 inch) in width, and 0.9 mm (0.032 inch) thick. In other variants (not shown), the antenna width is reduced to 25 mm (1 inch) or 20 mm (0.79 inch), while keeping the same length and thickness.

Other embodiments of the invention configure the antenna apparatus to cover WWAN (e.g., 824 MHz-960 MHz, and 1710 MHz-2170 MHz), and/or WiMAX (2.3 and 2.5 GHz) frequency bands. Yet other frequency bands may be achieved as desired, using variations in the configuration of the apparatus.

The directly-fed LFB antenna arms (106, 136) of the exemplary embodiment are configured as substantially diamond-shaped elongated polygons. That is, the width of each of the arms 106, 136 is smaller than the length. In the embodiment shown in FIG. 1, one end of each arm features a tuning element 122, 150, and the other end (128) is truncated to effect precise antenna tuning to the desired bands of operation. The radiator arm diamond shape provides good electromagnetic coupling to the HFB arms, and produces a wide band response in the lower frequency band.

Another exemplary embodiment of the dipole antenna according to the present invention is shown in FIG. 1A. The antenna component 158 of this embodiment includes a top sub-assembly 159 and a bottom sub-assembly 161, each configured similarly to the antenna sub-assemblies 101, 131 of the device of FIG. 1 described supra. In the embodiment of FIG. 1A, one end of each arm of the directly-fed LFB structure 162, 166 features a triangular-shaped tuning element (similar to the element 122 of the embodiment of FIG. 1), and the opposing end of the arm features a trapezoidal-shaped tuning element 168, each configured to effect antenna tuning to the desired bands of operation.

It is appreciated by those skilled in the art that a multitude of other antenna radiating structures are equally compatible and useful with the present invention such as, inter alia, the LFB radiators shaped as shown in the antenna embodiment of FIG. 1B. The antenna component 170 of this embodiment includes a top sub-assembly 171 and the bottom sub-assembly 172, each configured similarly to the antenna sub-assemblies 101, 131 of FIG. 1 described supra. In the embodiment of FIG. 1B, each arm 174, 176 of the direct-fed LFB structures is shaped as a rhomboid with a triangular-shaped tuning element 178 (similar yet smaller compared to the element 122 of the embodiment of FIG. 1) disposed on one end, that is proximate to the direct connection to the transmission lines 110, 140.

An embodiment of the antenna apparatus, comprising multiband dipole antenna components (such as shown and described with respect to FIGS. 1-1B, supra) is presented in FIG. 1C in the form of a "radome". The antenna apparatus 180 of FIG. 1C includes the antenna component (such as, for example, the component 170 of FIG. 1B) encapsulated in a radome structure 182. The top antenna sub-assembly 171 of FIG. 1B is shown in white, and portions of the bottom antenna sub-assembly 172 of FIG. 1B are shown in black in FIG. 1C. One end of the antenna apparatus 180 features a mounting flange 184, which is used to attach the antenna during operation and to route a feed cable 186.

The radome structure 182 is preferably fabricated using thermoplastic materials such as e.g., polycarbonate (PC), or Acrylonitrile Butadiene Styrene (ABS). The radome 182 provides mechanical support for the antenna radiating elements and protection from the elements during use. As the radome 182 affects RF field distribution and antenna resonance frequency, tuning of the antenna assembly (that uses the exact radome structure of the final product) is required.

In the antenna embodiments shown and described above with respect to FIGS. 1-1C, antenna feed couplings are disposed proximate one lateral edge of the dielectric substrate. To facilitate antenna mounting and coupling to the feed cable, both coupling structures (such as the feed point 104 and the ground coupling point 120) are disposed on the same side of the substrate. Such coupling configuration simplifies attachment of the RF feed cable to the antenna sub-assemblies, and optimizes antenna resonances with different connector types. In one variant, the feed cable is attached to the dipole antenna component using an RF connector, or a mechanical friction joint (crimp, push and lock), or any other suitable technology.

It is appreciated by those skilled in the arts that the above feed coupling configuration is merely exemplary, and other implementations are usable as well, such as for example soldering the feed conductor to the top sub-assembly and the ground conductor to the bottom sub-assembly.

The exemplary antenna embodiments shown and described with respect to FIGS. 1-1C, supra, utilize a single feed antenna configuration such that the antenna radiators of one band (for example the lower band) are fed directly via a feed strip (the transmission line 110), and the antenna radiators of a second bands (HFB) are fed by way of electromagnetic coupling. The top antenna sub-assembly (such as, for example, the sub-assembly 101 of FIG. 1) is connected to the feed conductor of the radio device and acts as one arm of the dipole, while the bottom antenna sub-assembly (such as, for example, the sub-assembly 131 of FIG. 1) is connected to the ground conductor, and acts as a ground base arm of the dipole.

The exemplary antenna configuration (such as that shown in FIG. 1) includes two side-by-side dipoles in a vertical plane that are combined by the transmission line (110), thus providing the desired omni-directional antenna radiation pattern in azimuthal plane, as illustrated by the antenna performance results described below.

Performance

Referring now to FIGS. 2 through 8-11, performance results obtained during testing by the Assignee hereof of an exemplary antenna apparatus constructed according to the invention are presented.

Figure 2:
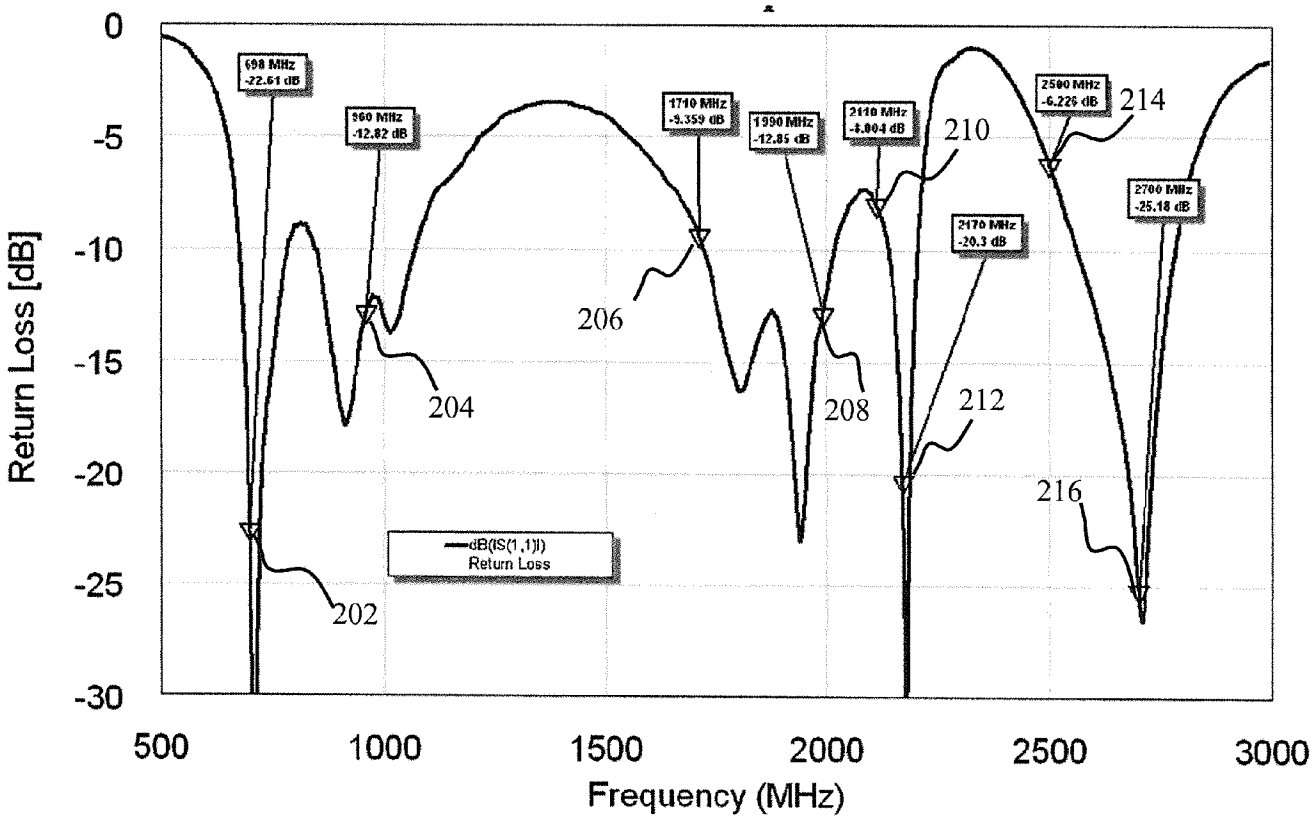
FIG. 2 is a plot of measured free space input return loss of the exemplary multiband dipole antenna of the embodiment of FIG. 1B.

FIG. 2 shows a plot of free-space return loss S11 (in dB) as a function of frequency, measured with a single-feed dipole antenna component constructed in accordance with the embodiment shown and described with respect to FIG. 1B, supra, The return loss data clearly show the exemplary antenna comprising several distinct frequency bands from 600 MHz to 2700 MHz. The designators 202-216 mark the frequencies 698 MHz, 960 MHz, 1710 MHz, 1990 MHz, 2110 MHz, 2170 MHz, 2500 MHz, and 2700 MHz, respectively.

Figure 3:
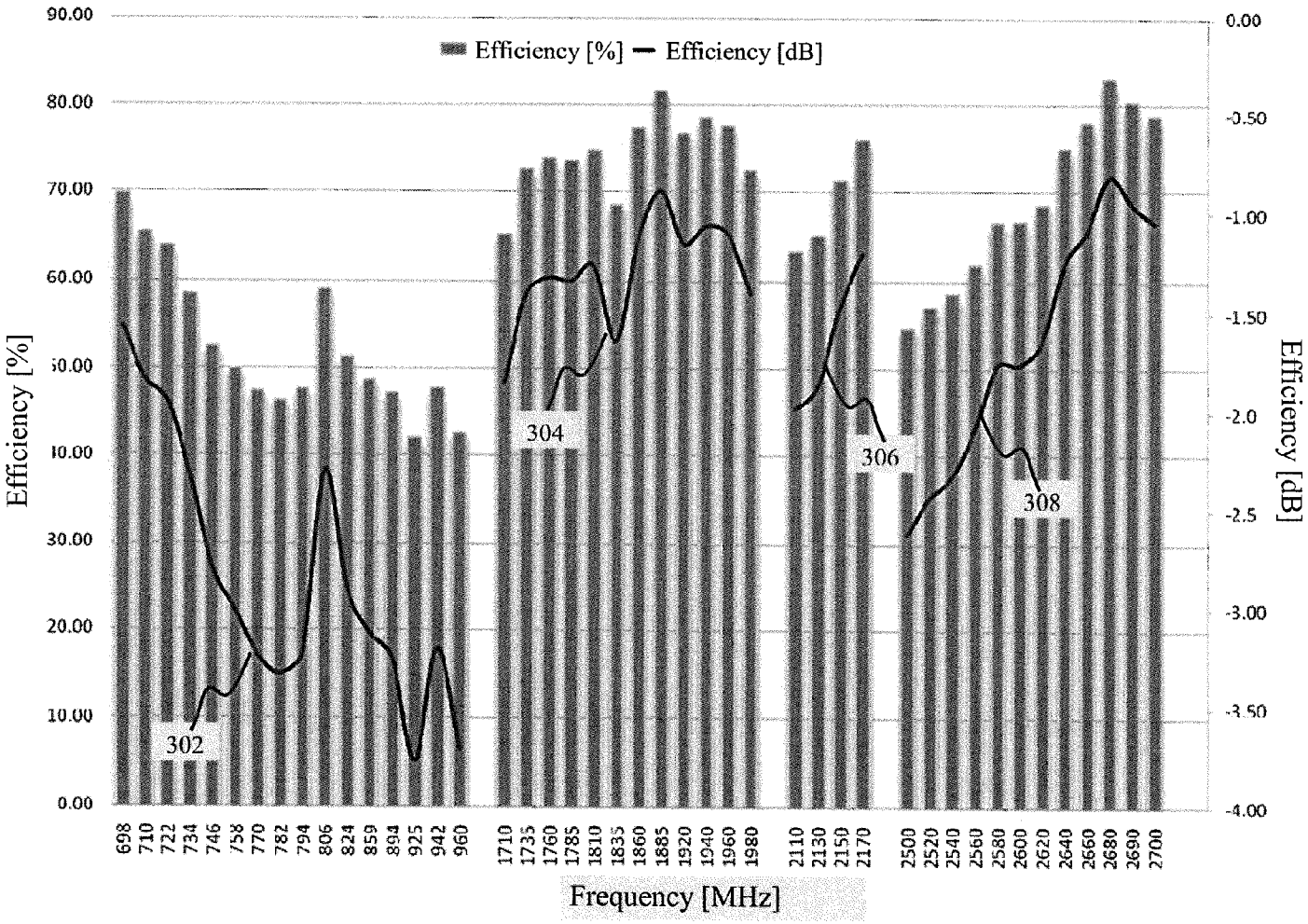
FIG. 3 is a plot of measured total efficiency of the exemplary multiband dipole antenna of the embodiment of FIG. 1B.

FIG. 3 presents data regarding measured free-space efficiency for the same antenna configuration (i.e., that of FIG. 1B). Antenna efficiency (in dB) is defined as decimal logarithm of a ratio of radiated and input power:

$$AntennaEfficiency[\text{dB}]10\log_{10}\left(\frac{\text{Radiated Power}}{\text{Input Power}}\right) \quad \text{Eqn. (1)}$$

while antenna efficiency (in %) is defined as follows:

$$AntennaEfficiency[\%] = 100\times\left(\frac{\text{Radiated Power}}{\text{Input Power}}\right) \quad \text{Eqn. (2)}$$

An efficiency of zero (0) dB or 100% corresponds to an ideal theoretical radiator, wherein all of the input power is radiated in the form of electromagnetic energy. The data in FIG. 3, shown both in dB (solid line) and in % (vertical bars), are collected in the following frequency bands: (i) the lower band 698-960 MHz; (ii) the first upper band 1710-1980 MHz; (iii) the second upper band 2110-2170 MHz, and (iv) the third upper band 2500-2700 MHz, denoted with the designators 302-308, respectively. The data of FIG. 3 demonstrate LFB efficiency between 65% and 90% in a lower portion of the lower band, decreasing to 40% level at the upper edge of the LFB. The first upper band (304) efficiency is above 60% throughout the band, and the second upper band has efficiency between 35% and 70%. The third upper band 308 shows efficiency in a range between 30% and 70%. These results confirm that the antenna HFB radiating elements configuration (such as, for example structures 112, 142 of FIG. 1) enables tuning of the HFB separately from the LFB, and demonstrate that an antenna structure according to the invention advantageously enables simultaneous antenna operation in several different frequency bands over a frequency range that is wider than supported by presently available antenna solutions of similar sizes.

Figure 4:
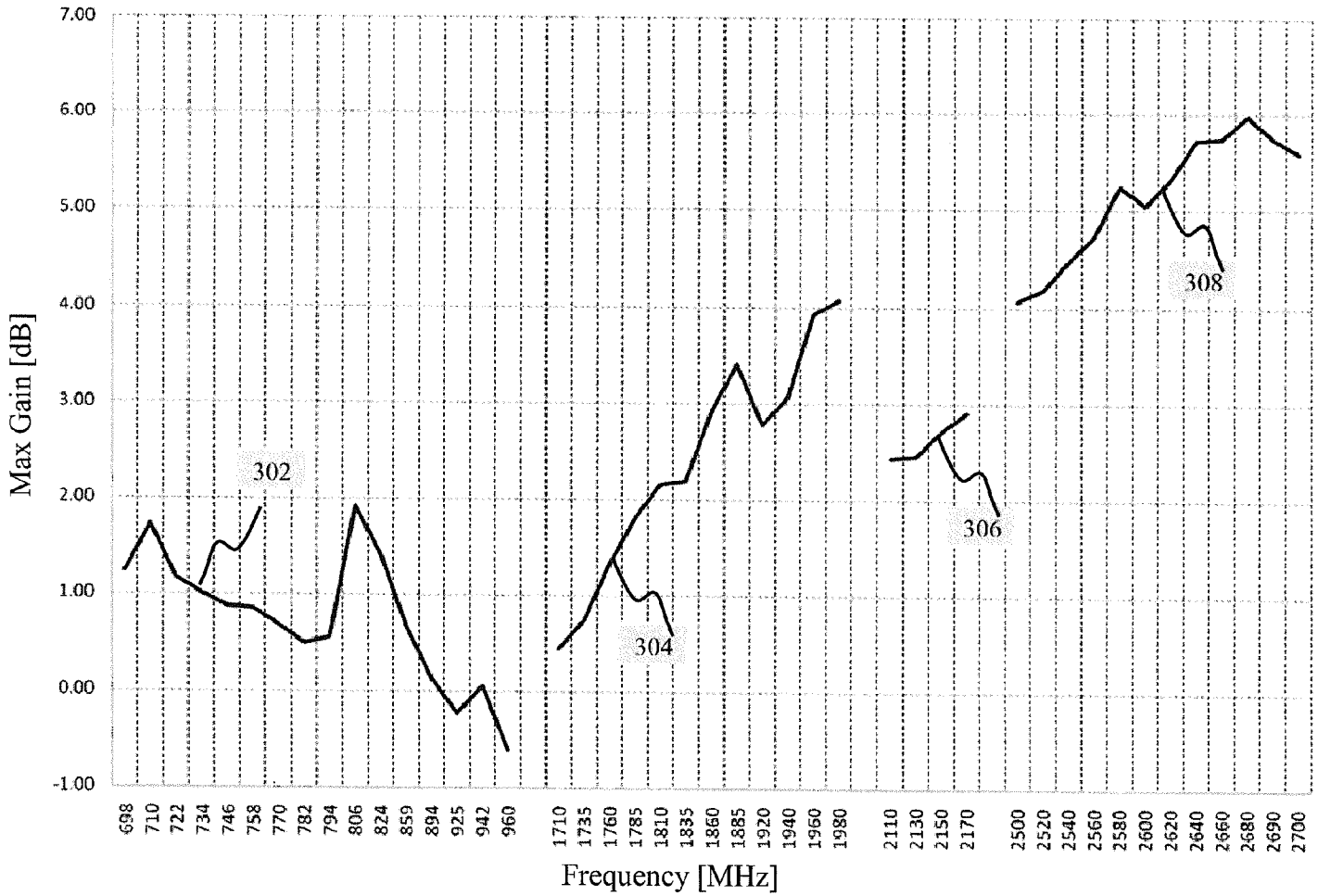
FIG. 4 is a plot of measured maximum antenna gain of the exemplary multiband dipole antenna of the embodiment of FIG. 1B.

FIG. 4 presents data regarding measured maximum antenna gain obtained with the same antenna configuration (FIG. 1B). The data in FIG. 4 confirm antenna gain between −0.5 and 3 dB in the LFB, 0 to 4 dB in the first upper band, and 4 to 6 dB in the second upper band.

Figure 5:
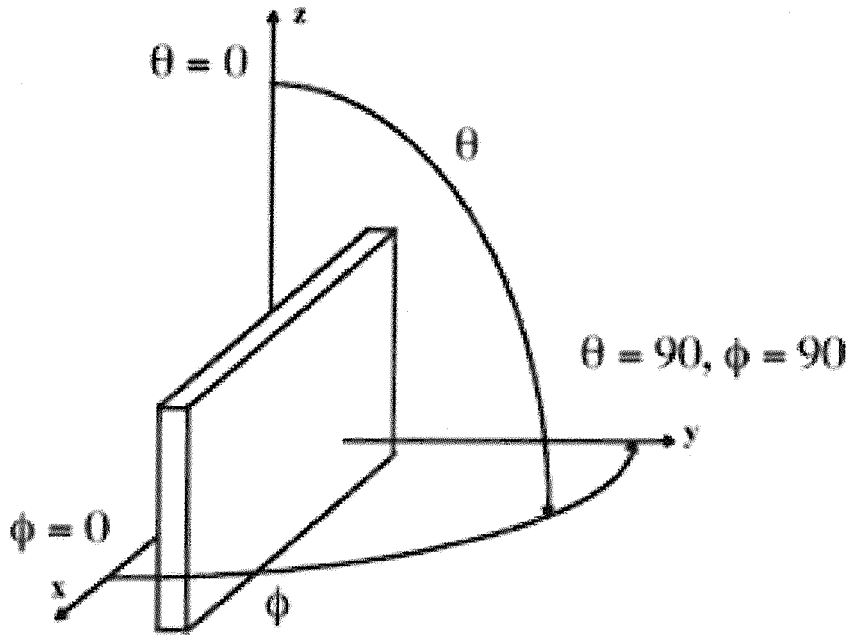
FIG. 5 is a diagram illustrating an exemplary coordinate system used in radiation pattern measurements.
Figures 1, 6:
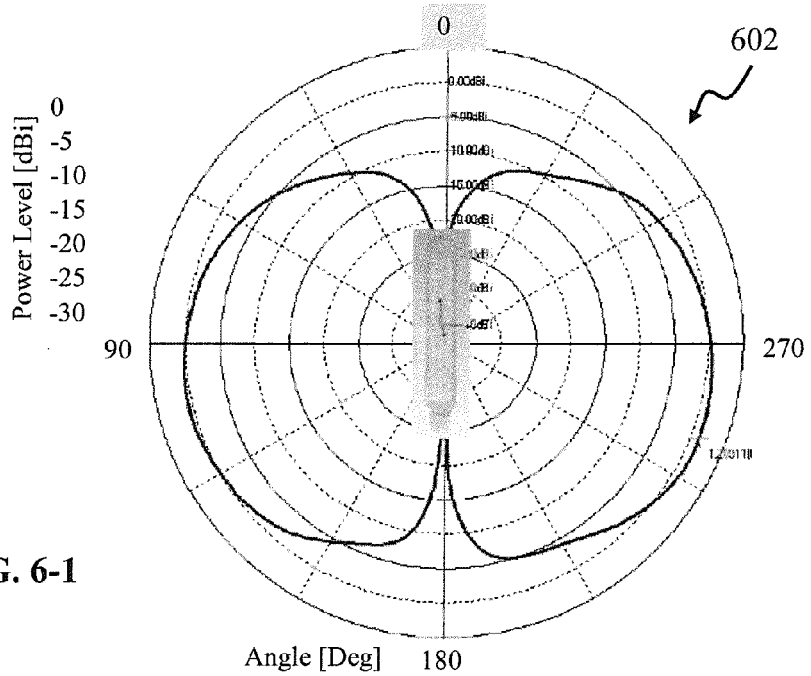
Figures 2, 6:
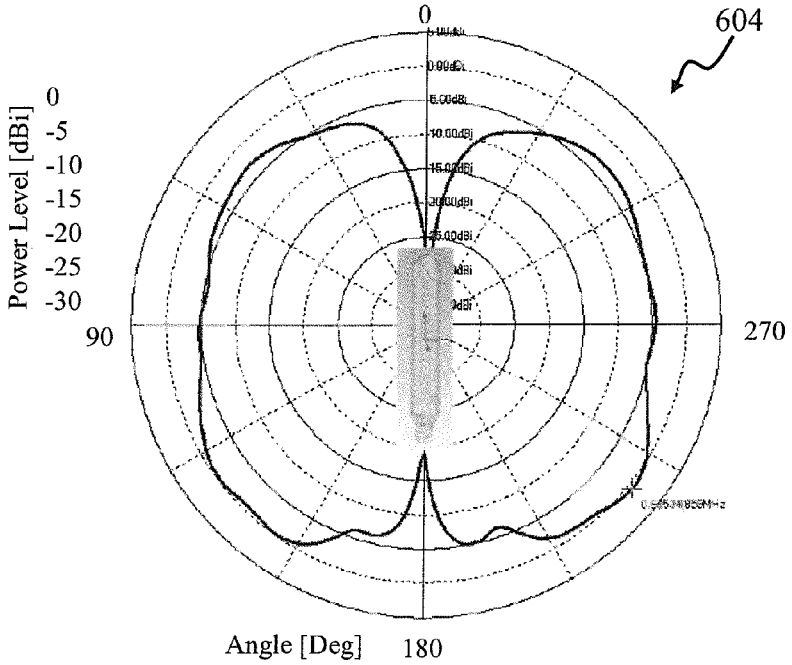
Figures 3, 6:
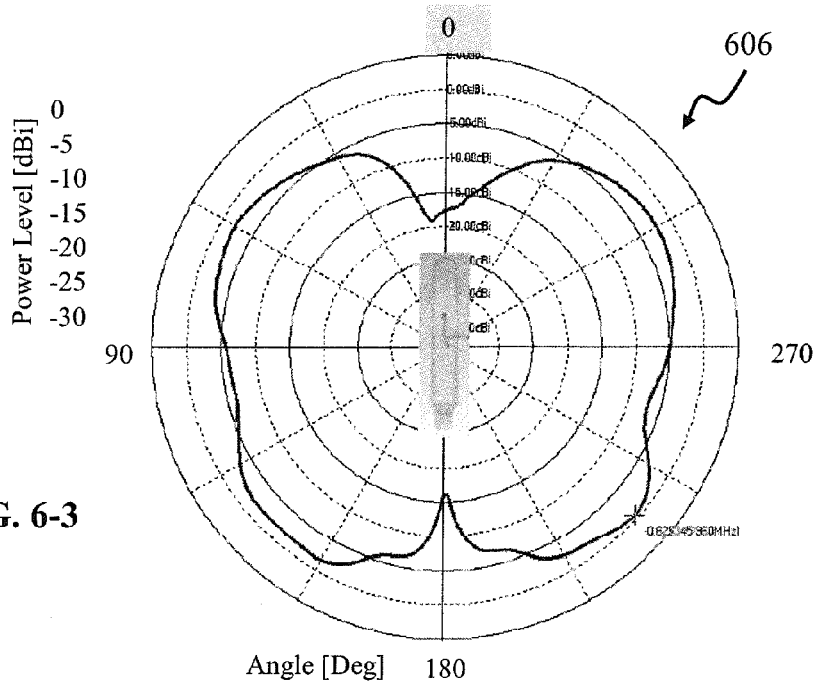
Figures 4, 6:
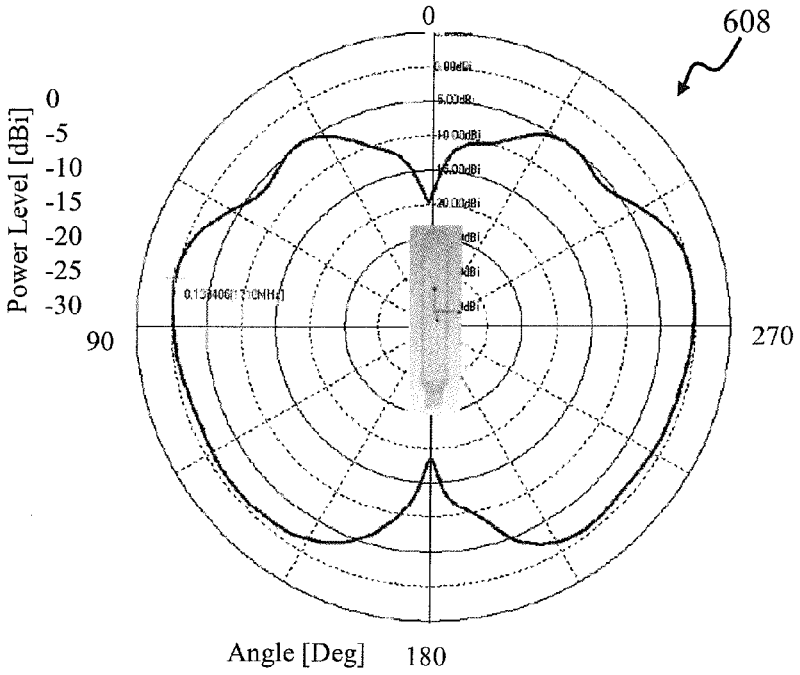
Figures 5, 6:
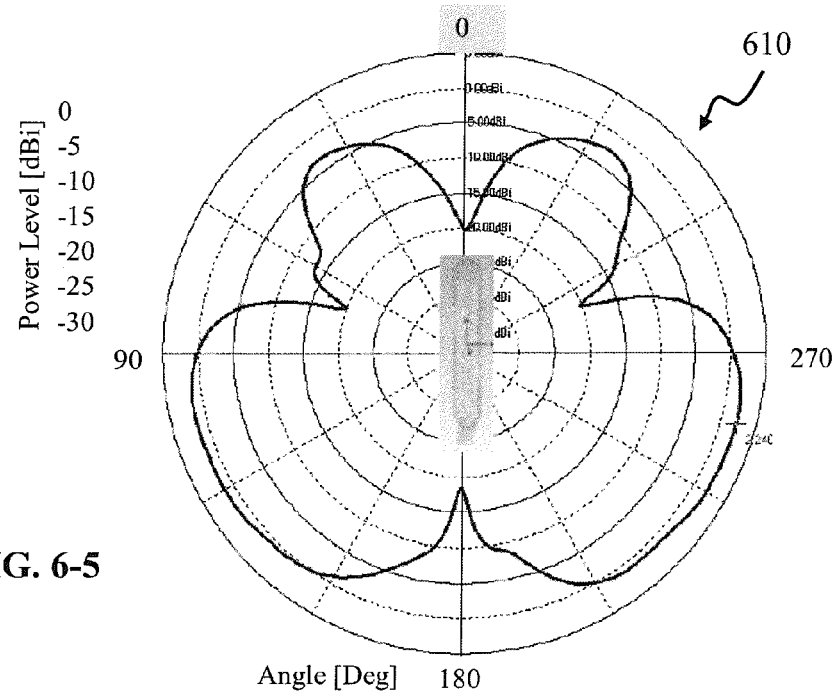
Figure 6:
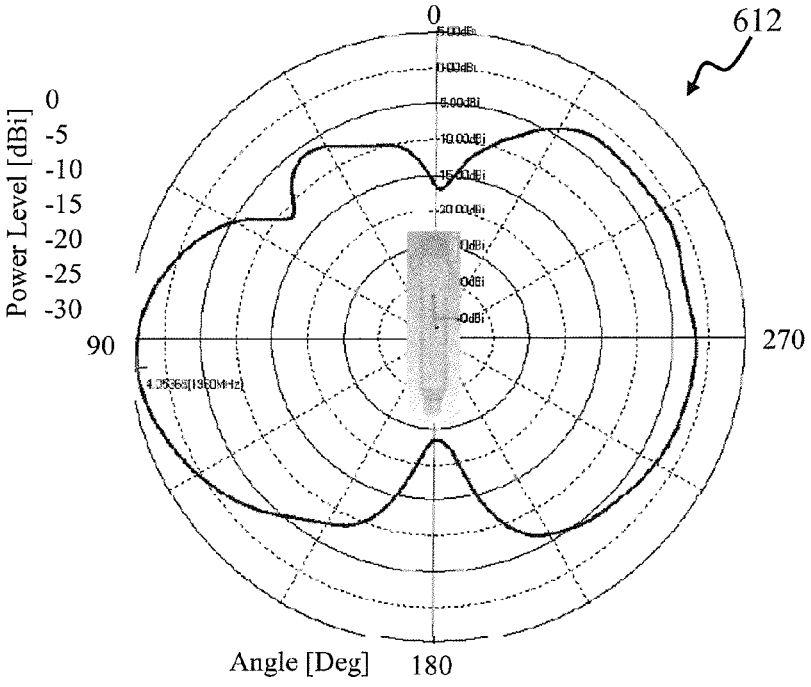
Figures 6, 7:
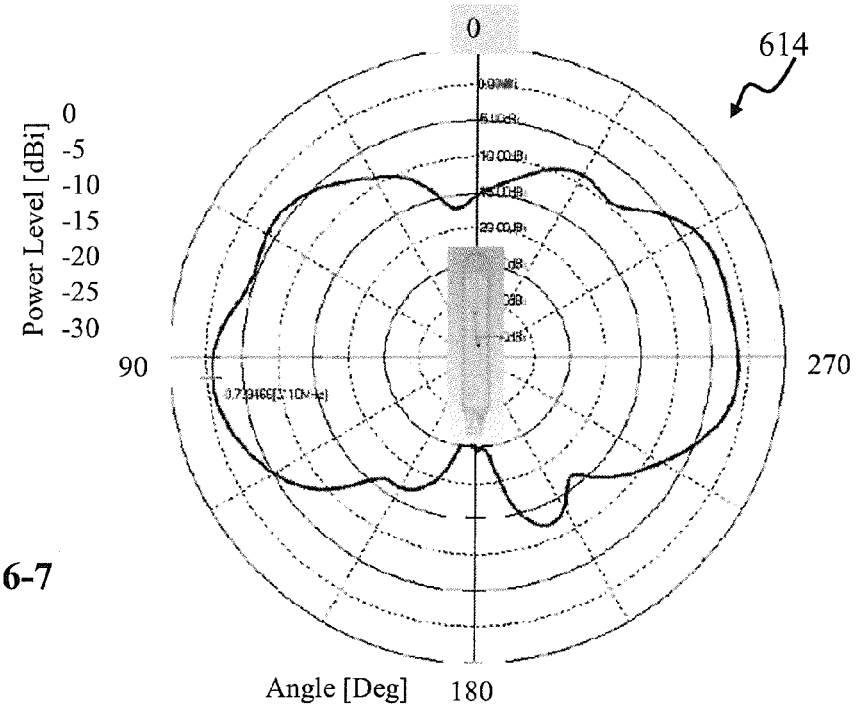
Figures 6, 7, 8:
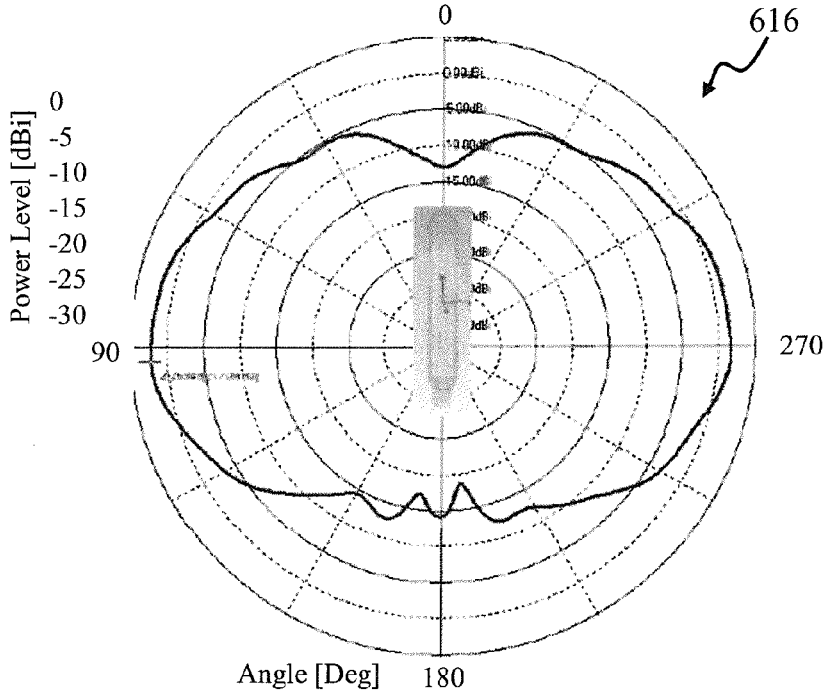
Figures 6, 7, 8, 9:
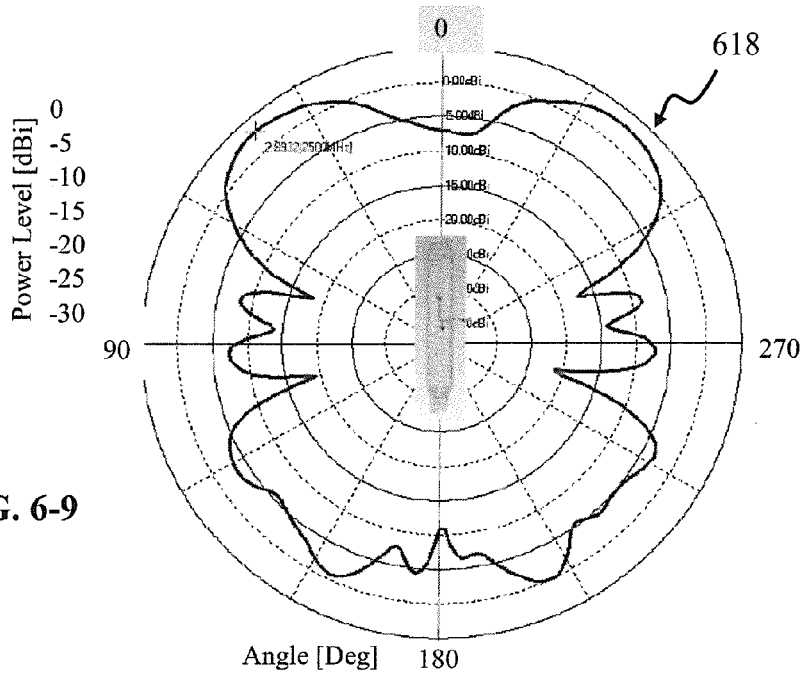
Figures 6, 7, 8, 9, 10:
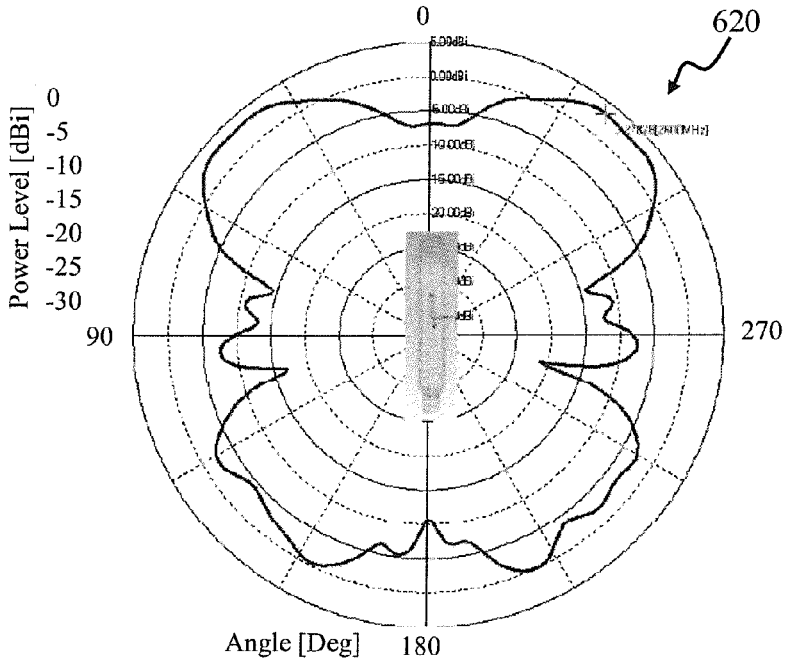
Figures 6, 7, 8, 9, 10, 11:
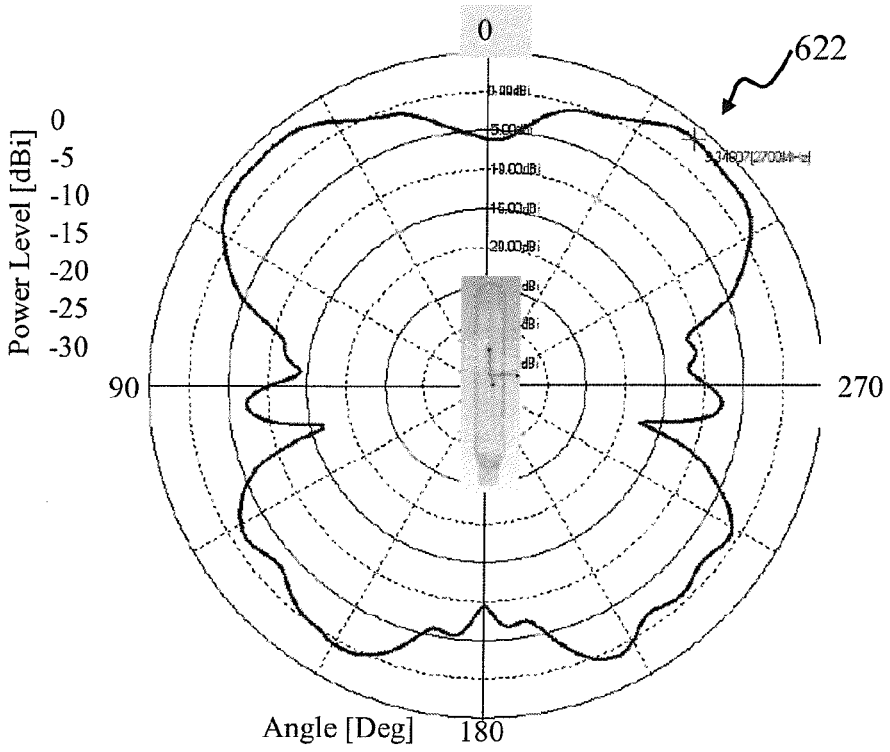
Figures 1, 7:
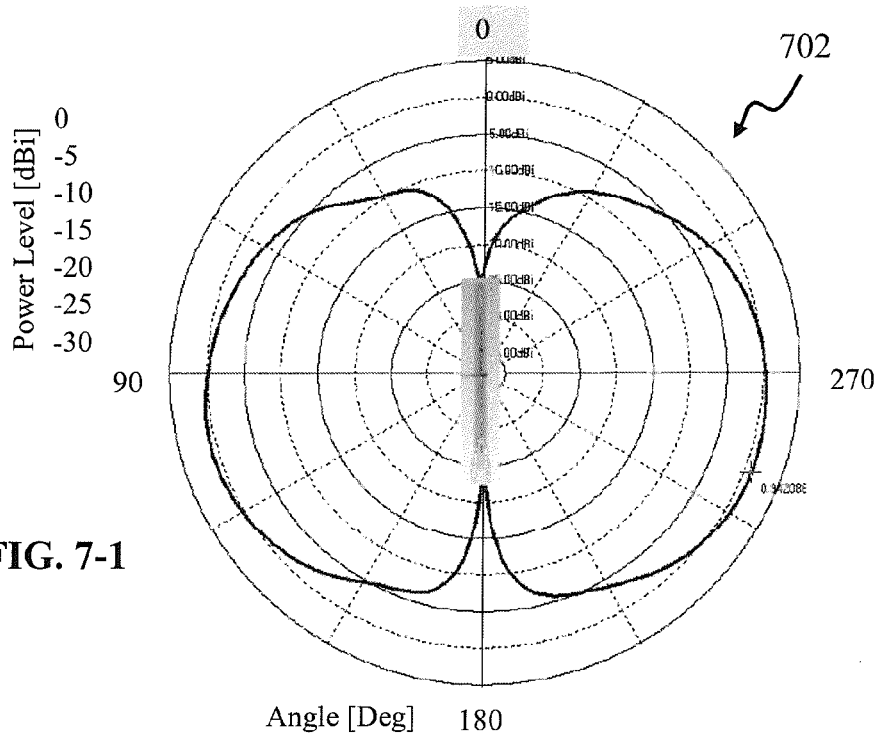
Figures 2, 7:
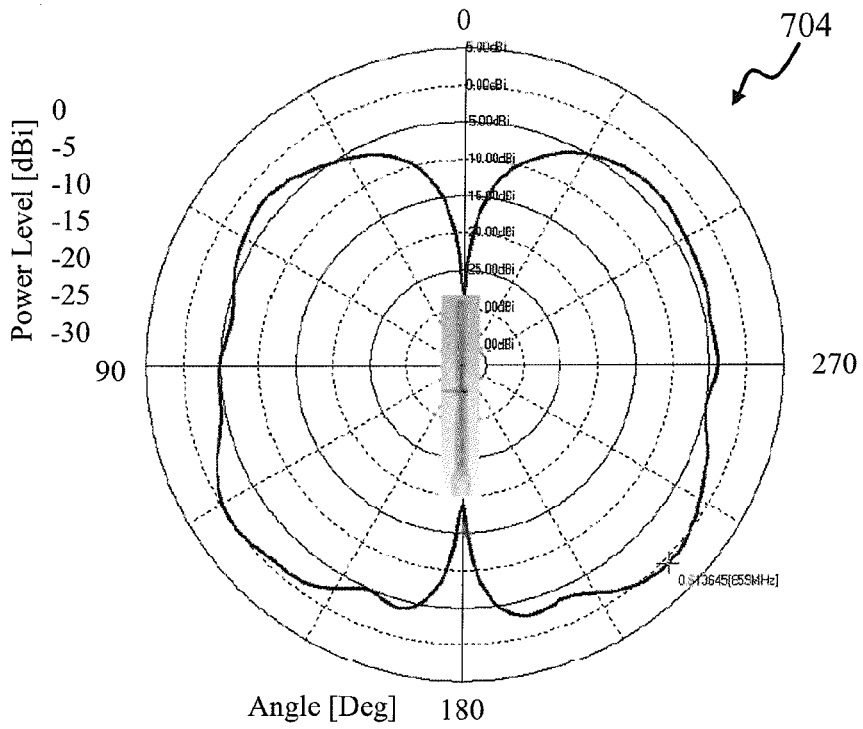
Figures 3, 7:
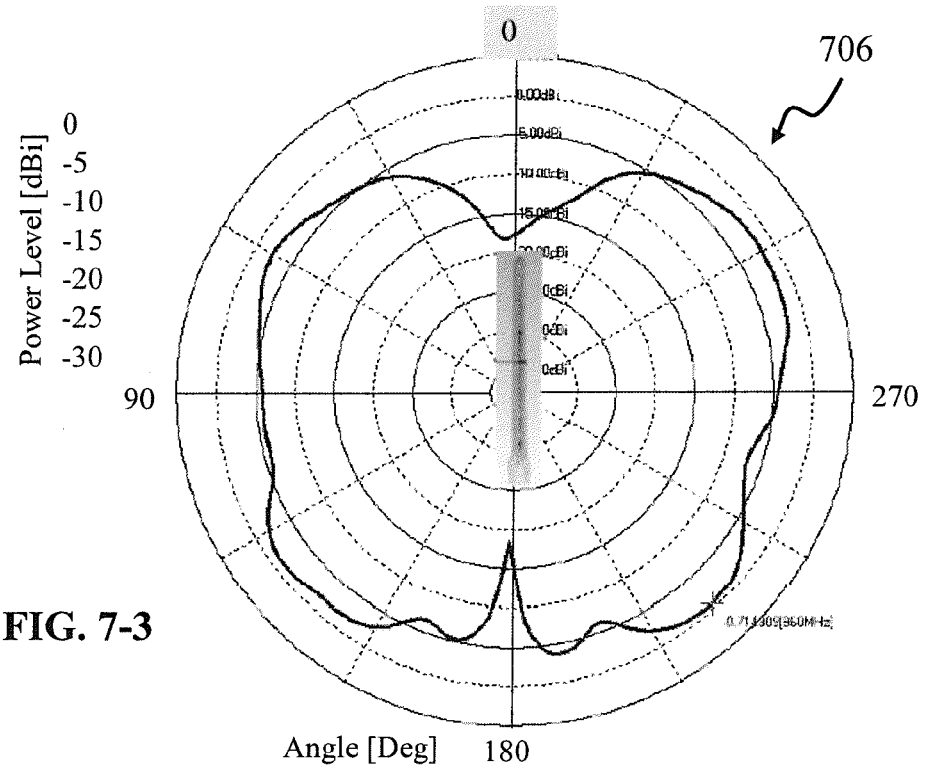
Figures 4, 7:
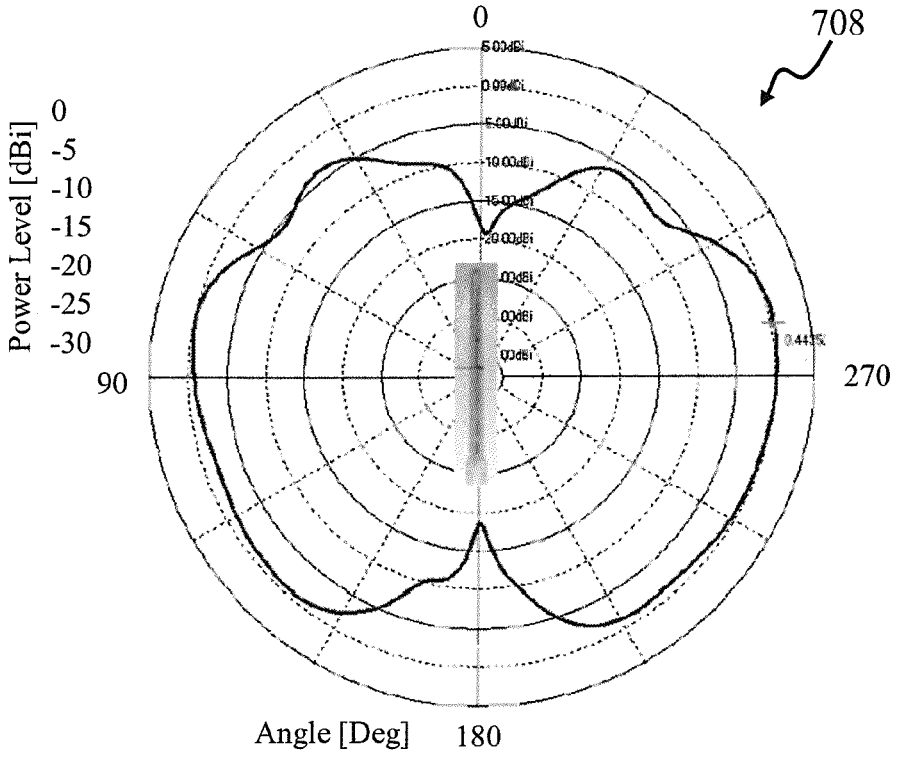
Figures 5, 7:
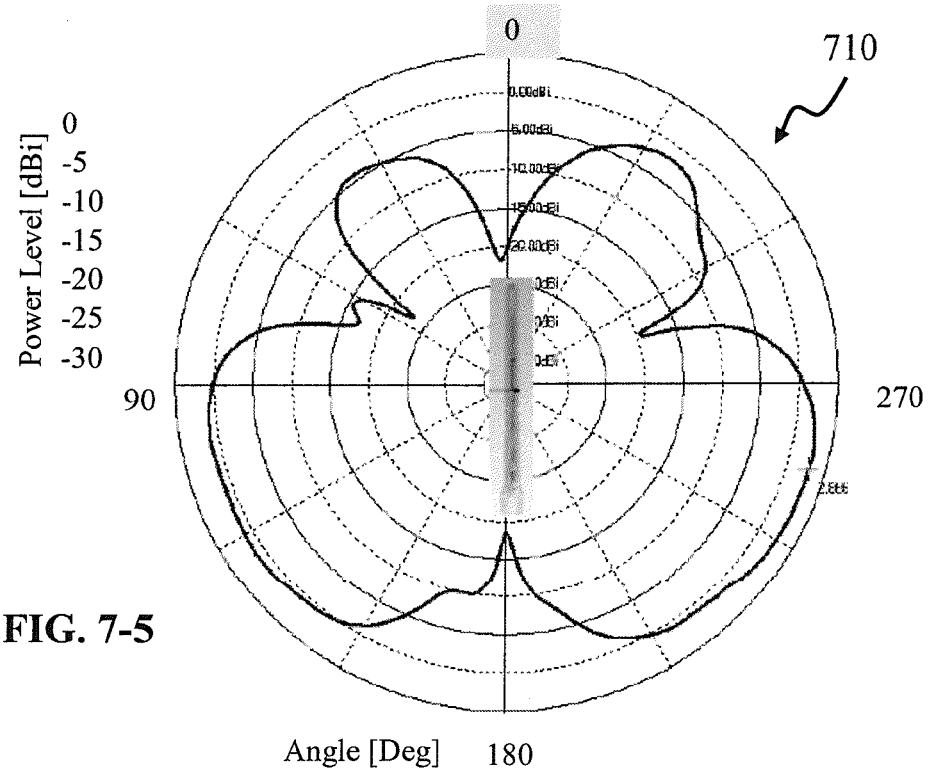
Figures 6, 7:
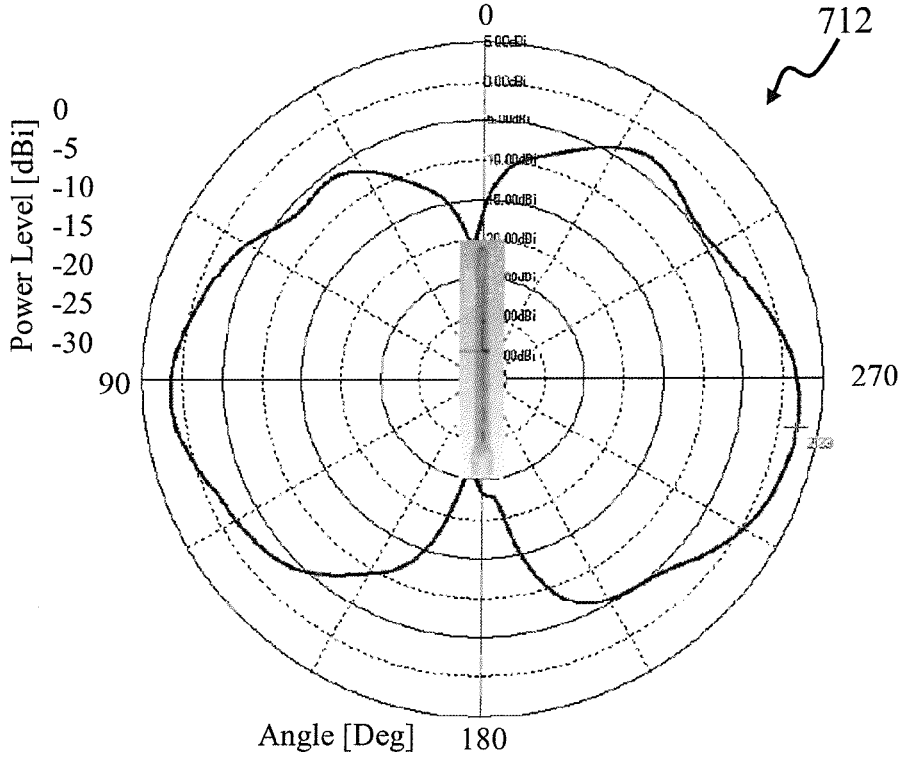
Figure 7:
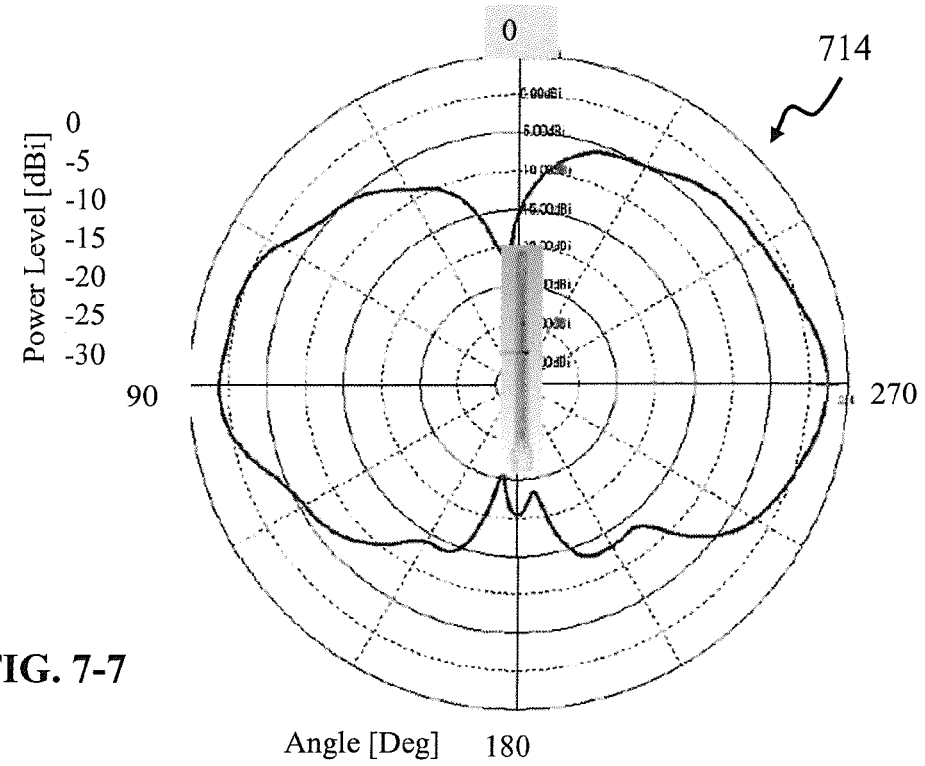
Figures 7, 8:
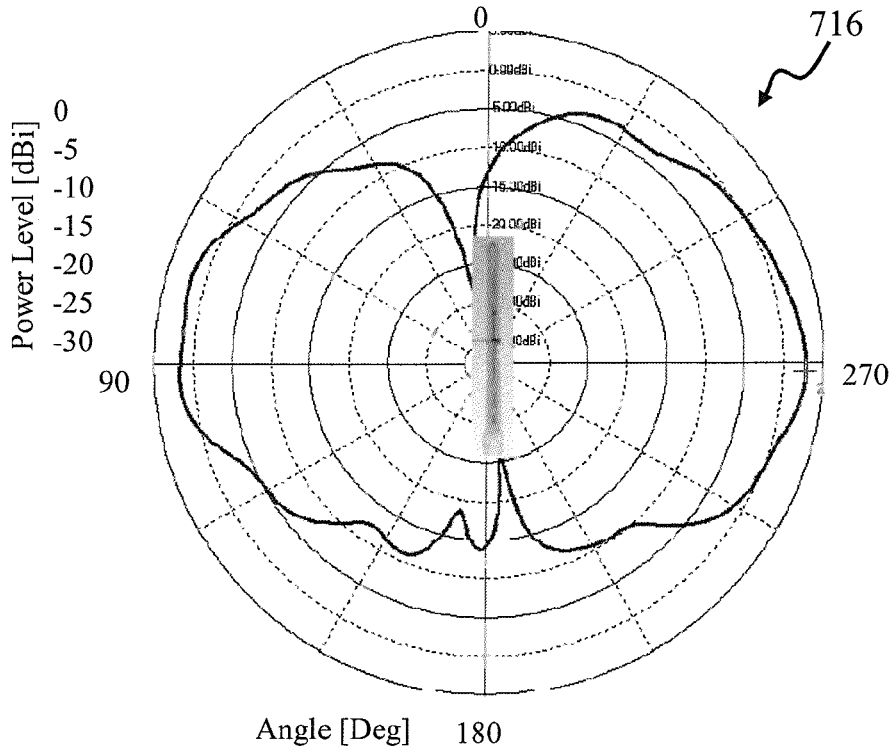
Figures 7, 8, 9:
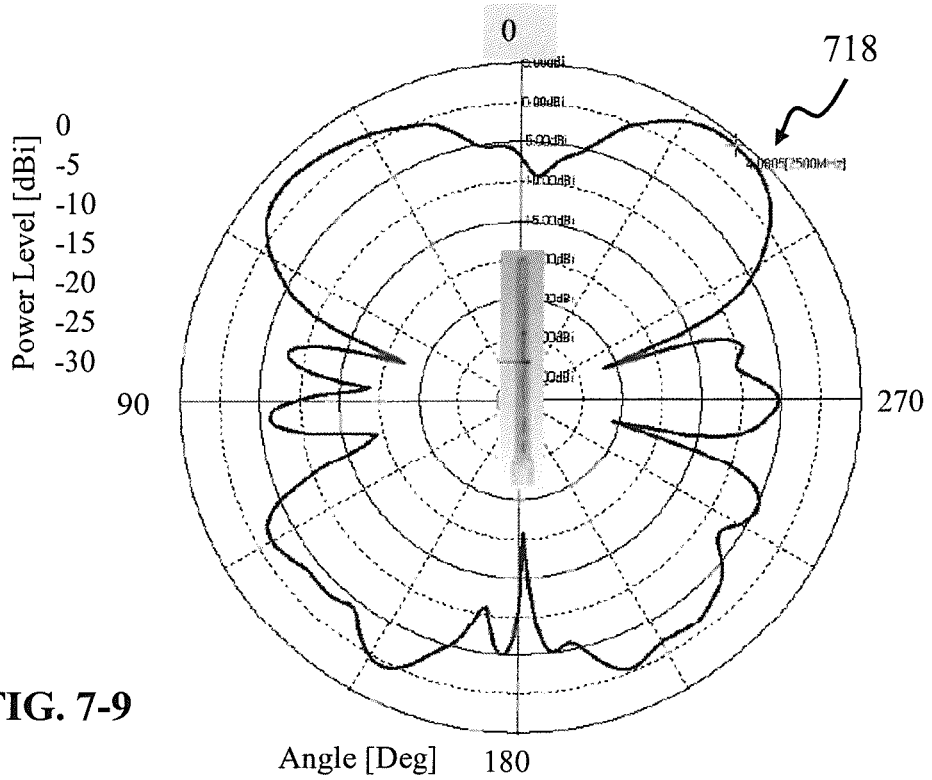
Figures 7, 8, 9, 10:
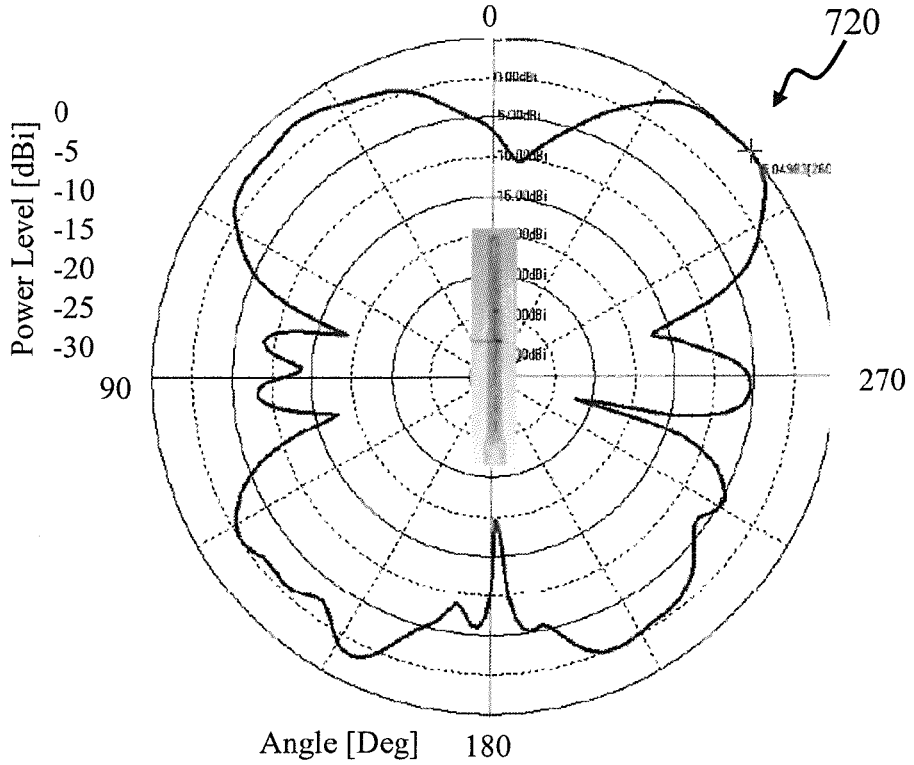
Figures 1, 8:
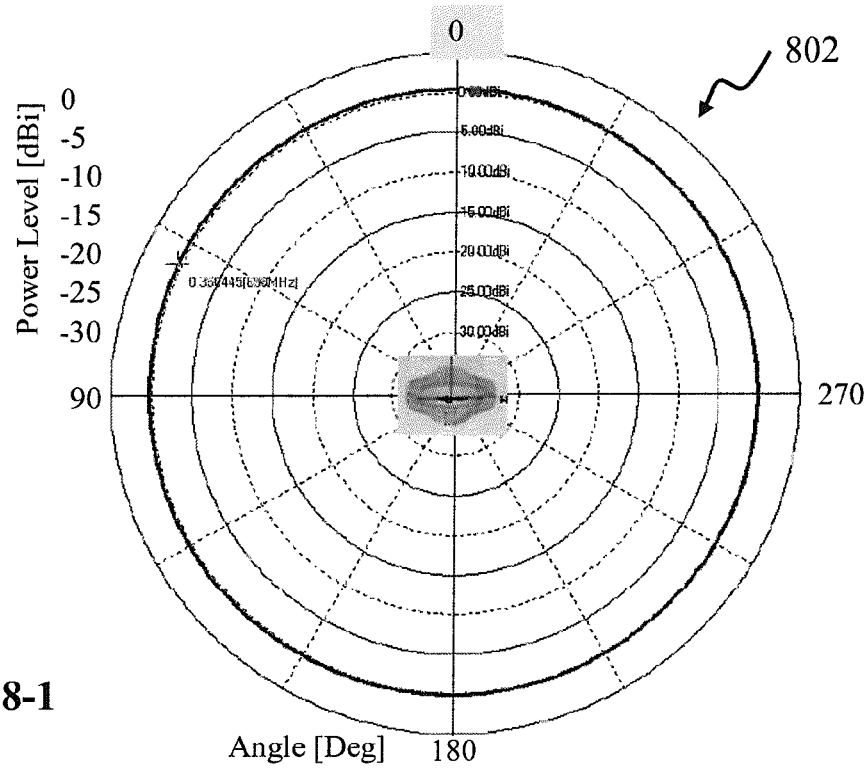
Figures 2, 8:
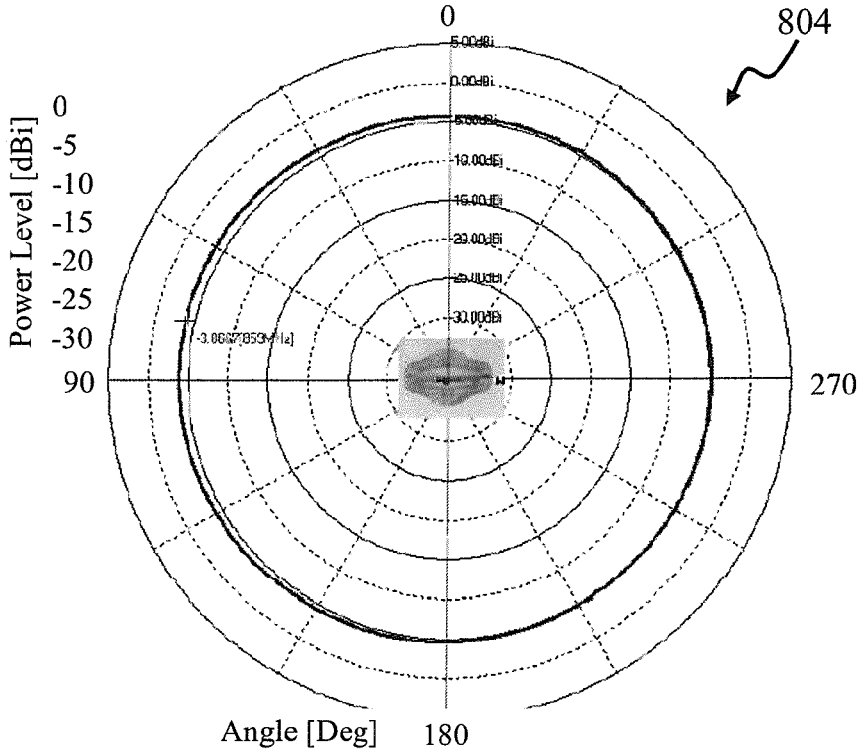
Figures 3, 8:
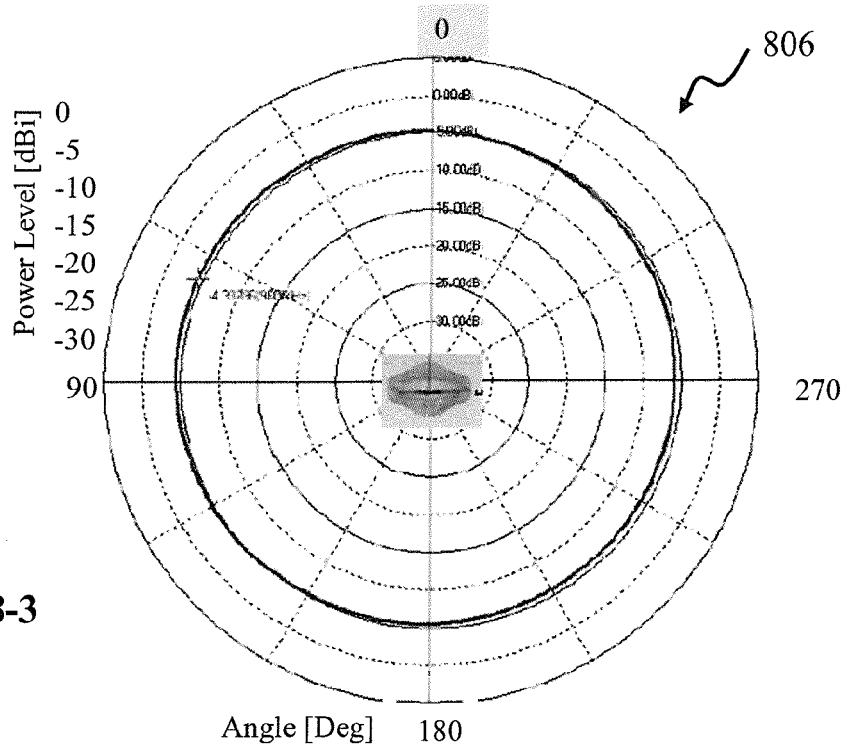
Figures 4, 8:
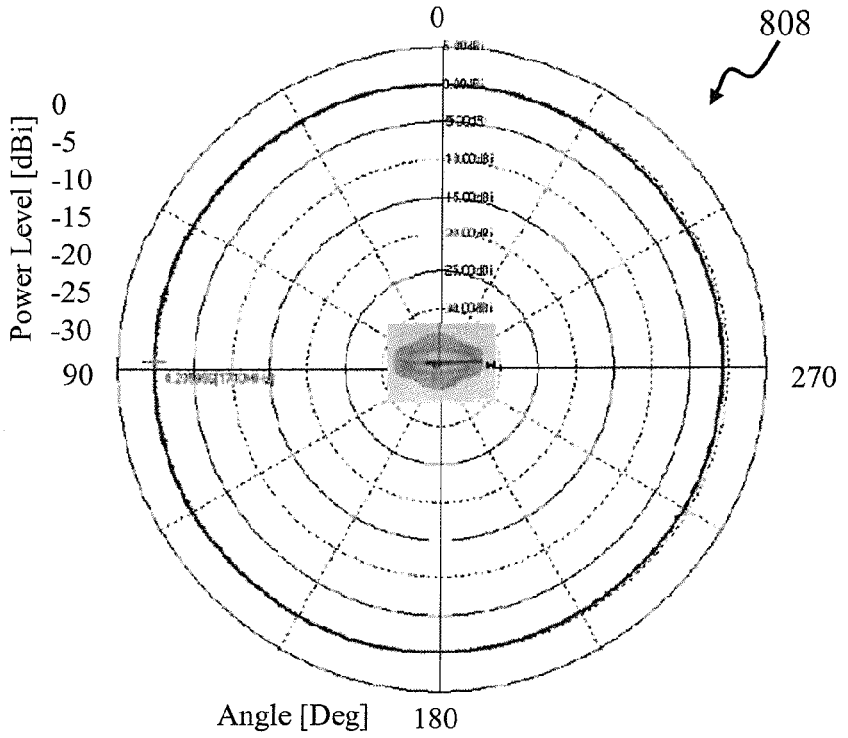
Figures 5, 8:
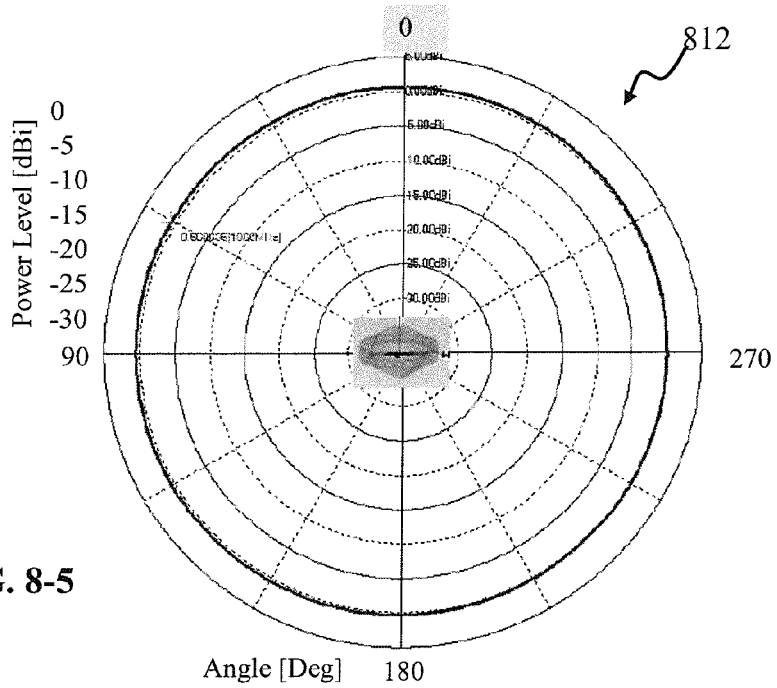
Figures 6, 8:
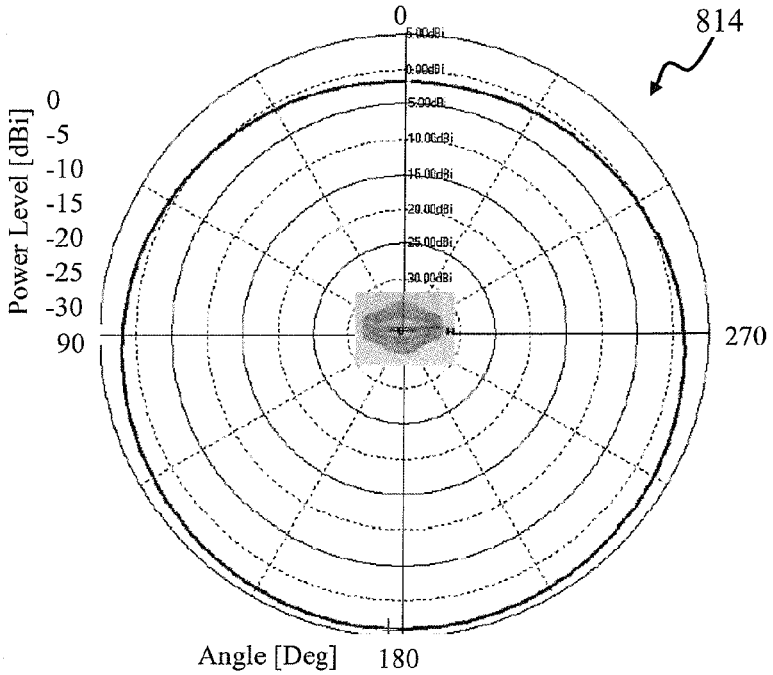
Figures 7, 8:
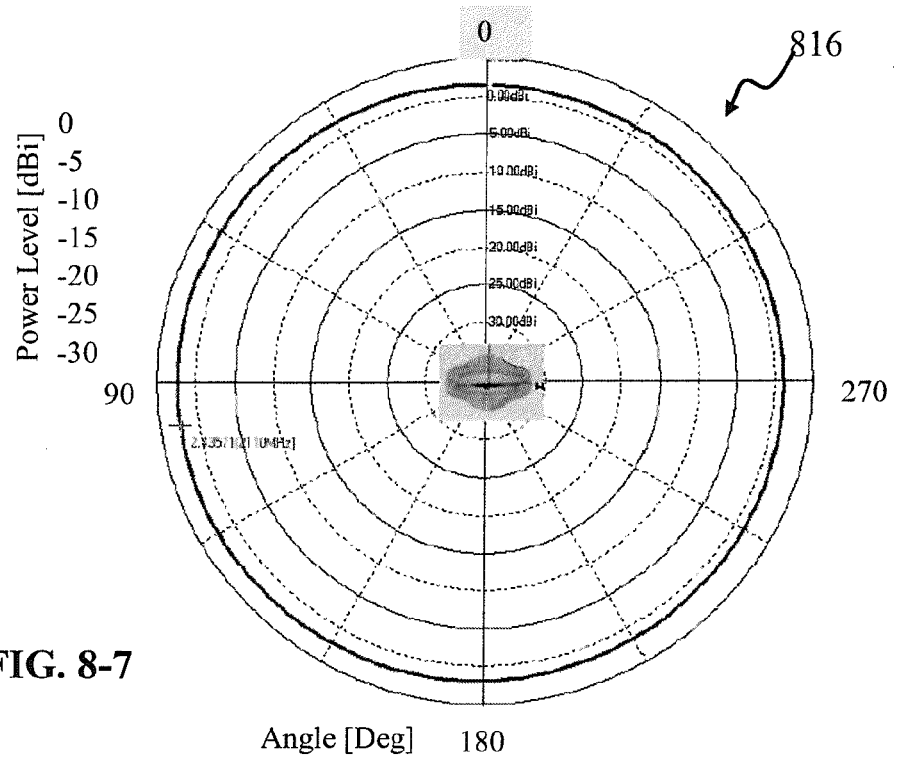
Figure 8:
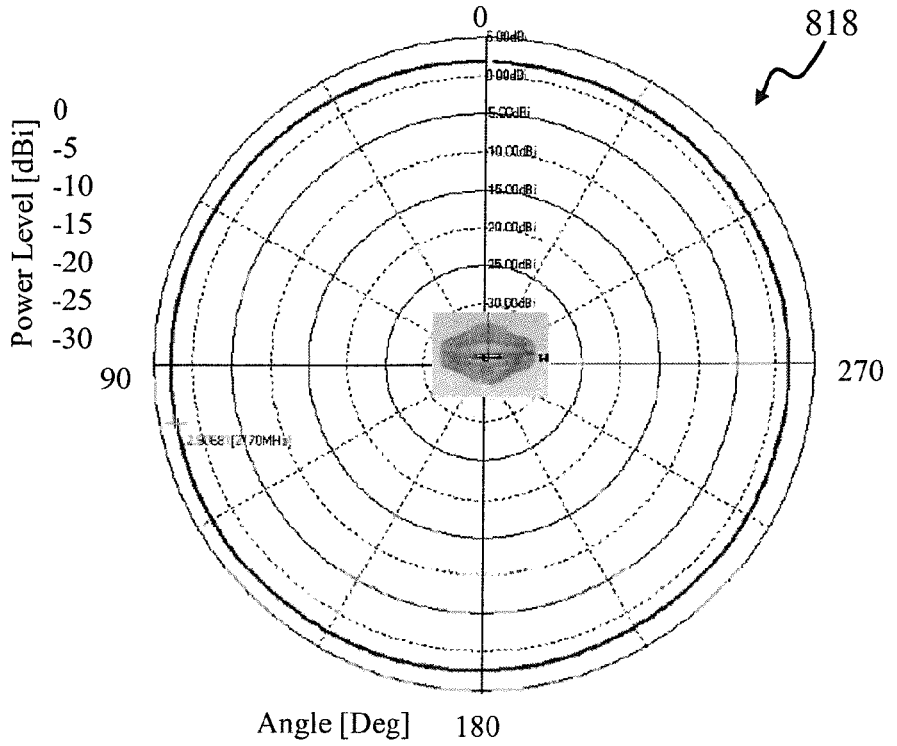
Figures 8, 9:
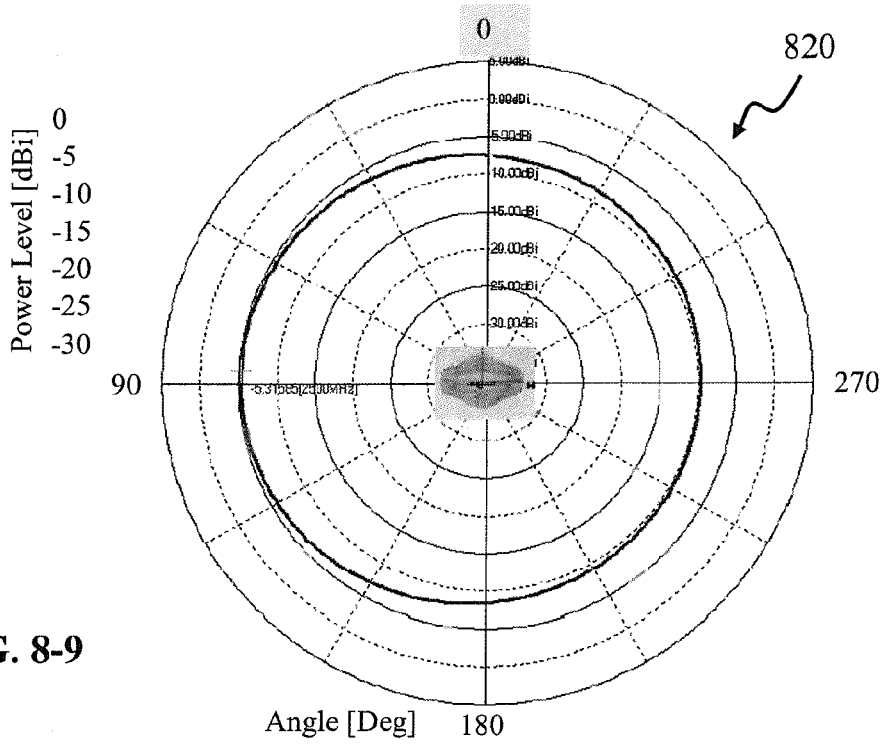
Figures 8, 9, 10:
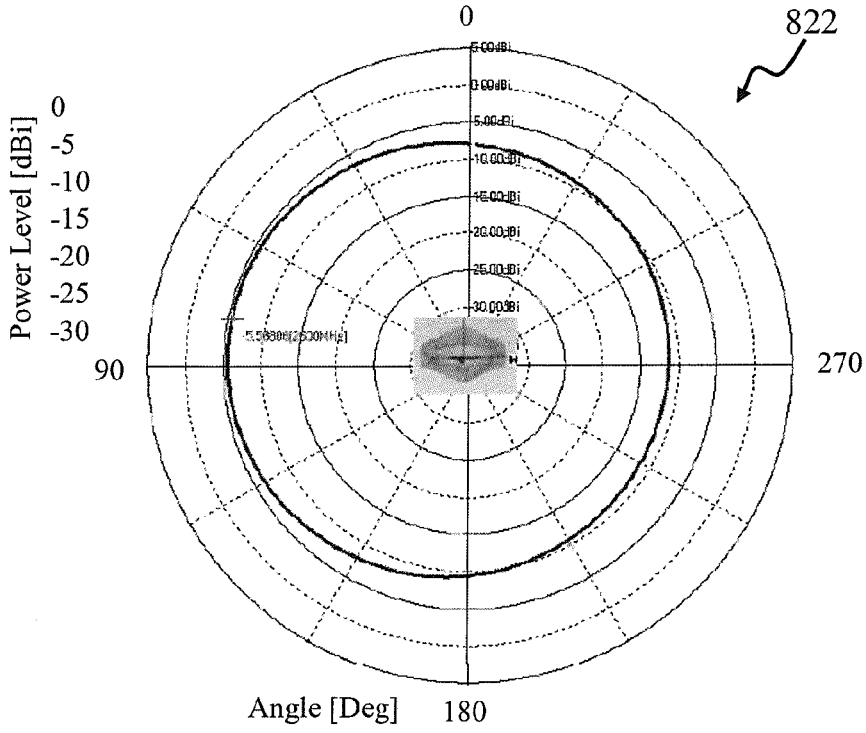
Figures 8, 9, 10, 11:
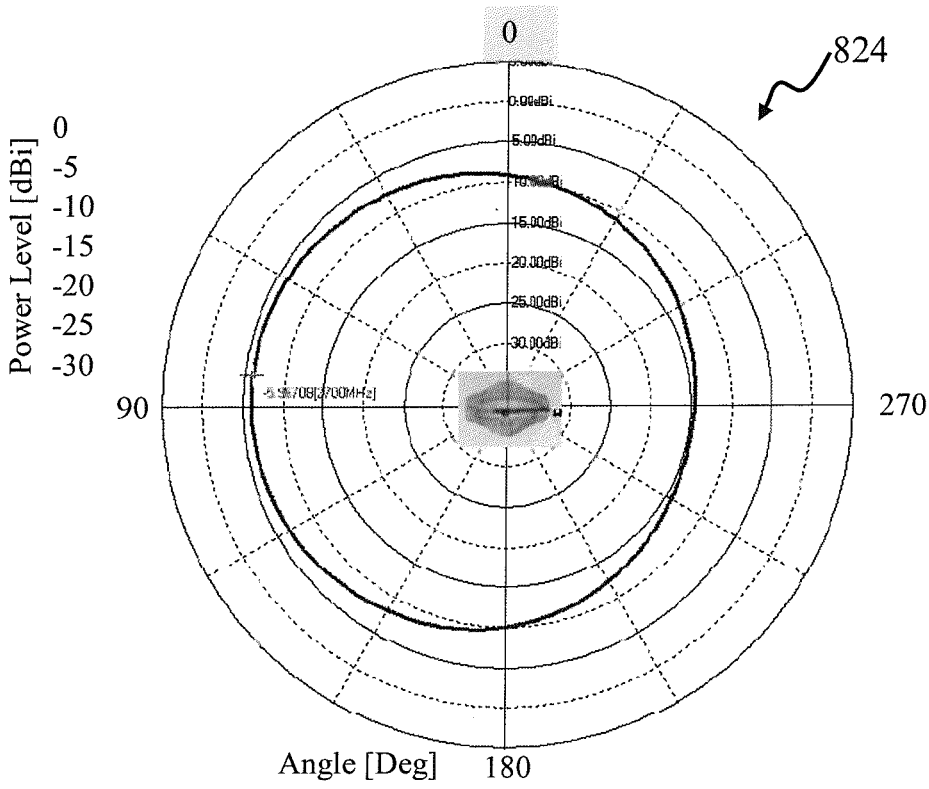

FIGS. 5 through 8-11 present data related to measured radiating pattern of the exemplary multiband dipole antenna configured in accordance with the embodiment of FIG. 1B. FIG. 5 illustrates an exemplary coordinate system and definitions useful for interpreting the radiating patterns of FIGS. 6-1 through 8-11. In FIG. 5, θ is the elevation angle, ϕ is the azimuth angle, and the x-y plane (θ=90 deg.) corresponds to the azimuth plane. The azimuth plane radiation patterns are obtained with measurements made while traversing the entire x-y plane around the antenna under test. The elevation plane in FIG. 5 is defined as a plane orthogonal to the x-y plane. The elevation plane with the angle ϕ=90 deg corresponds to the y-z plane, while the elevation plane with the angle ϕ=0 deg. corresponds to the x-z plane. The elevation plane patterns are obtained traversing the entire y-z plane around the antenna under test. The above definitions are used in describing exemplary antenna radiation patterns with respect to FIGS. 6-8, described below.

FIGS. 6-1 through 6-11 present data regarding measured elevation-plane ((x, z), ϕ=0 deg.) radiation patterns of the exemplary multiband dipole antenna configured in accordance with the embodiment of FIG. 1B. Different radiation pattern plots, denoted by the designators 602-622, correspond to the frequencies of antenna operation of: (i) 698 MHz; (ii) 859 MHz; (iii) 960 MHz, (iv) 1710 MHz, (v) 1860 MHz, (vi) 1980 MHz, (vii) 2110 MHz, (viii) 2170 MHz, (ix) 2500 MHz, (x) 2600 MHz, and (xi) 2700 MHz, respectively.

FIGS. 7-1 through 7-10 are plots of measured elevation-plane ((y, z), (ϕ=90 deg.) radiation pattern of the exemplary multiband dipole antenna configured in accordance with the embodiment of FIG. 1B. Measurements obtained at different frequencies of (i) 698 MHz; (ii) 859 MHz; (iii) 960 MHz, (iv) 1710 MHz, (v) 1860 MHz, (vi) 1980 MHz, (vii) 2110 MHz, (viii) 2170 MHz, (ix) 2500 MHz, and (x) 2600 MHz are denoted by the designators 702-720, respectively.

The radiation patterns 602-616 of FIGS. 6-1 through 6-11 and 702-716 of FIGS. 7-1 through 7-10 demonstrate a typical dipole antenna radiation pattern, with the maximum power achieved at elevation angles of 90 and 270 deg, as expected. While the radiation patterns 618-622 and 718-720 obtained at the highest frequencies (2500 MHz, 2600 MHz, and 2700

MHz, respectively) show noticeable deviations from the dipole behavior, they provide sufficient performance in most typical operational conditions.

FIGS. 8-1 through 8-11 are plots of measured azimuth-plane (x, y) radiation pattern of the exemplary multiband dipole antenna configured in accordance with the embodiment of FIG. 1B obtained at frequencies of (i) 698 MHz; (ii) 859 MHz; (iii) 960 MHz, (iv) 1710 MHz, (v) 1860 MHz, (vi) 1980 MHz, (vii) 2110 MHz, (viii) 2170 MHz, (ix) 2500 MHz, (x) 2600 MHz, and (xi) 2700 MHz, as denoted by the designators 802-824, respectively. The data presented in FIGS. 8-1 through 8-11 demonstrate excellent omni-directional antenna performance extending throughout the high frequencies, including 2700 MHz.

The data presented in FIGS. 2-4 and FIGS. 6-1 through 8-11 confirm that a single planar dipole antenna, configured in accordance with the invention, is capable of efficient operation in the LTE frequency ranges of 698-960 MHz, 1710-1980 MHz, 2110-2170 MHz, and 2500-2690 MHz, providing omni-directional radiation with a gain of 2 dBi, a level of performance that is unattainable with prior art single-feed dipole antenna solutions. Such capability provided by the present invention advantageously allows operation of a radio frequency device (such as a corporate wireless access point, wireless bridge or a wireless hub) with a single antenna over several mobile frequency bands such as GSM710, GSM750, GSM850, E-GSM900 GSM810, GSM1900, GSM1800, PCS-1900, as well as LTE/LTE-A and WiMAX (IEEE Std. 802.16) frequency bands. As persons skilled in the art will appreciate, the frequency band composition given above may be modified as required by the particular bands of the application(s), and additional bands may be supported/used as well. Furthermore, the electrical dimensions of an antenna configured in accordance with the invention can be scaled (up or down) in order to move operating bands of interest down/up, respectively. For example, if antenna dimensions are increased by a factor of two (compared to the embodiment of FIG. 1B), the corresponding operating frequency bands are scaled down by the same factor producing an antenna operating in a frequency range from about 350 MHz to about 1350 MHz. Similarly, an antenna that is half the size of the antenna of FIG. 1B will operate in a frequency range from about 1400 MHz to about 5400 MHz.

Advantageously, an antenna apparatus configuration comprising planar dipole antenna components as in the illustrated embodiments described herein allows for optimization of antenna operation in the lower frequency band simultaneously with the upper band operation. This antenna solution allows for, inter aria, a single standards-compliant (e.g., LTE-compliant) wireless device (such as a corporate access point, and back up for wireless link for data service) to cover several relevant frequency bands, while maintaining an improved dipole-type radiation pattern for most of the frequency range. This capability advantageously enables, among other things, fourth generation wireless (4G) swivel blade antennas for hubs, access points, routers and small base station, and femtocell 4G applications.

In addition, the use of the exemplary single-feed configuration simplifies antenna connections, and allows for a smaller and less complicated design of the device RF feed electronics.

In one implementation of the invention, an external antenna is employed to establish a small corporate access point and a backup wireless link for data service, and to serve established external antenna demand in LTE applications.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An antenna apparatus operable in a first frequency band and a second frequency band, the apparatus comprising:

a dielectric element comprising a first side and a second opposing side, a top antenna assembly disposed on the first side and a bottom antenna assembly disposed on the second opposing side, a feed point disposed on the first side, and a ground point disposed on the second opposing side;

a first pair of lower frequency band structures of the top antenna assembly operable in the first frequency band and disposed substantially on the first side, the first pair of lower frequency band structures galvanically coupled to the feed point;

a second pair of lower frequency structures of the bottom antenna assembly operable in the first frequency band and disposed substantially on the second opposing side, the second pair of lower frequency band structures galvanically coupled to the ground point;

a third pair of higher frequency band structures of the top antenna assembly operable in the second frequency band and disposed substantially on the first side, the third pair of higher frequency band structures electromagnetically coupled to the feed point; and a fourth pair of higher frequency band structures of the bottom antenna assembly operable in the second frequency band and disposed substantially on the second opposing side, the fourth pair of higher frequency band structures electromagnetically coupled to the ground point;

wherein:

the first pair of lower frequency band structures are positioned directly above the fourth pair of higher frequency band structures of the bottom antenna assembly and opposite the second pair of lower frequency band structures of the bottom antenna assembly disposed on second opposing side; and the second pair of lower frequency band structures are positioned directly below the third pair of higher frequency band structures and opposite the first pair of lower frequency band structures of the top antenna assembly disposed on the first side.

2. The antenna apparatus of claim 1, wherein the third pair of higher frequency band structures are configured to form an electromagnetic coupling to the first pair of lower frequency band structures, and the fourth pair of higher frequency band structures are is configured to form an electromagnetic coupling to the second pair of lower frequency band structures.

3. The antenna apparatus of claim 1, wherein:

the first pair of lower frequency band structures comprises a first radiator arm disposed substantially co-planar with, yet parallel to, a second radiator arm; and the second pair of lower frequency band structures comprises a third radiator arm disposed substantially co-planar with, yet parallel to, a fourth radiator arm.

4. The antenna apparatus of claim 3, further comprising:

a first substantially linear conductive element disposed on the first side and configured to couple the feed point to the first and the second radiator arms via a first T-junction; and a second substantially linear conductive element disposed on the second side and configured to couple the ground point to the third and the fourth radiator arms via a second T-junction.

5. The antenna apparatus of claim 3, wherein the first radiator arm and the second radiator arm each comprise a linear slot disposed substantially longitudinally within the respective arm.

6. The antenna apparatus of claim 1, further comprising:

a first conductive element disposed between an individual one of the first pair of lower frequency band structures and the feed point and effecting a galvanic coupling to the feed point;

a first electromagnetic coupling element electrically disposed between the first conductive element and a first branch of an individual one of the third pair of higher frequency band structures; and a second electromagnetic coupling element electrically disposed between the first conductive element and a second branch of the individual one of the third pair of higher frequency band structures;

wherein:

the first electromagnetic coupling element is configured to electromagnetically couple the first branch of the individual one of the third pair of higher frequency band structures to the feed point; and the second electromagnetic coupling element is configured to electromagnetically couple the second branch of the individual one of the third pair of higher frequency band structures to the feed point.

7. The antenna apparatus of claim 6, further comprising:

a second conductive element disposed between at least a portion of an individual one of the second pair of lower frequency band structures and the ground point, and effecting a galvanic coupling to the ground point;

a third electromagnetic coupling element electrically disposed between at least a portion of the second conductive element and a first branch of an individual one of the second pair of lower frequency band structures; and a fourth electromagnetic coupling element electrically disposed between at least a portion of the second conductive element and a first branch of the an individual one of the fourth pair of higher frequency band structures;

wherein:

the third electromagnetic coupling element is configured to electromagnetically couple the first branch of the individual one of the second pair of lower frequency band structures to the ground point; and the fourth electromagnetic coupling element is configured to electromagnetically couple the first branch of the individual one of the fourth pair of higher frequency band structures to the ground point.

8. The antenna apparatus of claim 7, further comprising a coupling structure disposed substantially on the first side and configured to electrically couple to the second conductive element disposed on the second opposing side.

9. The antenna apparatus of claim 8, wherein the electric coupling of the coupling structure disposed on the first side to the second conductive element disposed on the second opposing side is effected via a conductor that penetrates through the dielectric element in a direction normal to the first side.

10. The antenna apparatus of claim 1, wherein the first and the second pairs of lower frequency band structures are configured to cooperate to form at least a portion of a first dipole antenna operable in the first frequency band; and the third and the fourth pairs of higher frequency band structures are configured to cooperate to form at least a portion of a second dipole antenna operable in the second frequency band.

11. The antenna apparatus of claim 10, wherein the antenna apparatus is characterized by a substantially omni-directional radiation pattern in at least one of the first frequency band and the second frequency band, in a plane substantially normal to the dielectric element.

12. The antenna apparatus of claim 10, wherein antenna operation in the second frequency band is effected at least in part by a higher mode resonance in the first frequency band.

13. The antenna apparatus of claim 10, wherein:

the first frequency band comprises a lower frequency long term evolution (LTE) application band;

and the second frequency band comprises an upper frequency LTE application band.

14. A multiband antenna component for use with a radio communications device, the antenna operable in a first frequency band and a second frequency band, the antenna component comprising:

a dielectric element comprising a top antenna assembly disposed on a first side of the dielectric element, and a bottom antenna assembly disposed on an opposing second side of the dielectric element, said dielectric element having a first and a second end;

a first lower frequency band structure of the top antenna assembly operable in the first frequency band and disposed substantially on the first end of the first side, the first lower frequency band structure electrically coupled to the feed point;

a second lower frequency band structure of the bottom antenna assembly operable in the first frequency band and disposed substantially on the second end of the opposing second side, the second lower frequency band structure electrically coupled to the ground point;

a third higher frequency band structure of the top antenna assembly operable in the second frequency band and disposed substantially on the first side, the third higher frequency band structure electromagnetically coupled to the feed point; and a fourth higher frequency band structure of the bottom antenna assembly operable in the second frequency band and disposed substantially on the opposing second side, the fourth higher frequency band structure electromagnetically coupled to the ground point;

wherein:

the first lower frequency band structure of the top antenna assembly is positioned directly above the fourth higher frequency band structure and opposite the second lower frequency band structure of the bottom antenna assembly; and the second lower frequency band structure of the bottom antenna assembly is positioned directly below the third higher frequency band structure and opposite the first lower frequency band structure of the top antenna assembly.

15. The antenna component of claim 14, wherein the first frequency band comprises a lower frequency long term evolution (LTE) application band and second frequency band is selected from a group consisting of (i) 1710-1990 MHz, (ii) 2110-2170 MHz; and 2500-2700 MHz.

16. The antenna component of claim 14, wherein:

the first lower frequency band structure comprises a first radiator arm disposed substantially co-planar with yet parallel to a second radiator arm; and the second lower frequency band structure comprises a third radiator arm disposed substantially co-planar with yet parallel to a fourth radiator arm.

17. The antenna component of claim 16, wherein:

the first radiator arm comprises a first linear slot disposed substantially longitudinally within the first radiator arm; and the second radiator arm comprises a second linear slot disposed substantially longitudinally within the second radiator arm.

18. The antenna component of claim 16, further comprising:

a first conductive element disposed between the first lower frequency band structure and the feed point and effecting a connection of the first lower frequency band structure to the feed point;

a first electromagnetic coupling element electrically disposed between the first conductive element and a first branch of the third higher frequency band structure; and a second electromagnetic coupling element electrically disposed between the first conductive element and a second branch of the third higher frequency band structure;

wherein:

the first electromagnetic coupling element is configured to electromagnetically couple the first radiator arm to the feed; and the second electromagnetic coupling element is configured to electromagnetically couple the second radiator arm to the feed.

19. The antenna component of claim 14, further comprising:

a first conductive element disposed on the first side and configured to effect a connection between the feed and the first lower frequency band structure; and a second conductive element disposed on the second side and configured to effect a connection between the ground and the second lower frequency band structure.

20. The antenna component of claim 19, further comprising a structure disposed substantially on the first side and configured to electrically couple to the second conductive element disposed on the second side.

21. The antenna component of claim 14, wherein:

an outer perimeter of the first lower frequency band structure is configured to substantially overlap with an outer perimeter of the fourth higher frequency band structure; and an outer perimeter of the third higher frequency band structure is configured to substantially overlap with an outer perimeter of the second lower frequency band structure.

22. The antenna component of claim 14, wherein:

an outer perimeter of the first lower frequency band structure is configured to partially overlap with an outer perimeter of the fourth higher frequency band structure when viewed in a direction substantially normal to the first side; and an outer perimeter of the second lower frequency band structure is configured to partially overlap an outer perimeter of the third higher frequency band structure when viewed in the direction substantially normal to the first side.

23. The antenna component of claim 14, further comprising:

a fifth lower frequency band structure disposed substantially on the first side and configured to electromagnetically couple to the second lower frequency band structure; and a sixth lower frequency band structure disposed substantially on the second side and configured to electromagnetically couple to the first lower frequency band structure.

24. A method of enabling radio communications device operation using a multiband dipole antenna, the method comprising:

providing a feed signal to a feed disposed on a first side of a dielectric substrate, and to a coupling disposed on an opposing second side of the dielectric substrate, the dielectric substrate having first and second ends;

exciting a first pair of lower frequency band antenna structures disposed substantially on the first end of the first side of the dielectric substrate and electrically coupled to the feed so as to radiate in a first frequency band;

exciting a second pair of lower frequency band antenna structures disposed substantially on the second end on the opposing second side of the dielectric substrate and electrically coupled to a ground so as to radiate in the first frequency band;

causing a third pair of higher frequency band antenna structures disposed substantially on the first side and disposed directly above the second pair of lower frequency band structures to radiate in a second frequency band different than the first band by effecting electromagnetic coupling between the third pair of higher frequency band antenna structures and the feed;

causing a fourth pair of higher frequency band antenna structures disposed substantially on the second side and disposed directly below the first pair of lower frequency band structures to radiate in a second frequency band different than the first band by effecting electromagnetic coupling between the fourth pair of higher frequency band antenna structures and the ground;

causing a fifth pair of lower frequency band antenna structures disposed substantially on the second end of the first side of the dielectric substrate and above the second pair of lower frequency band structures to radiate in a first frequency band by effecting parasitic coupling between the fifth pair of lower frequency band antenna structures and the first pair of lower frequency band antenna structures; and causing a sixth pair of lower frequency band antenna structures disposed substantially on the first end of the opposing second side of the dielectric substrate and below the first pair of lower frequency band structures to radiate in a first frequency band by effecting parasitic coupling between the sixth pair of lower frequency band antenna structures and second pair of lower frequency band antenna structures.

25. The method of claim 23, wherein:

the first pair of lower frequency band antenna structures comprises a first radiator arm disposed substantially co-planar with yet parallel to a second radiator arm; and the second pair of lower frequency band antenna structures comprises a third radiator arm disposed substantially co-planar with yet parallel to a fourth radiator arm.

26. The method of claim 25, further comprising tuning an electromagnetic coupling of the third pair of higher frequency band antenna structures and the first pair of lower frequency band antenna structures, said tuning of the electromagnetic coupling of the third pair of higher frequency band antenna structures and the first pair of lower frequency band antenna structures being effected at least in part by a first linear slot disposed substantially longitudinally within the first radiator arm and a second linear slot disposed substantially longitudinally within the second radiator arm.

27. The method of claim 26, further comprising tuning an electromagnetic coupling of the fourth pair of higher frequency band antenna structures and the second pair of lower frequency band antenna structures, said tuning of the electromagnetic coupling of the fourth pair of higher frequency band antenna structures and the second pair of lower frequency band antenna structures being effected at least in part by a third linear slot disposed substantially longitudinally within the third radiator arm and a fourth linear slot disposed substantially longitudinally within the fourth radiator arm.

28. The method of claim 25, further comprising:

effecting electric coupling of the first pair of lower frequency band antenna structures to the feed via a first conductive element disposed therebetween;

effecting electromagnetic coupling of a first branch of an individual one of the third pair of higher frequency band structures and the feed via a first electromagnetic coupling element disposed electrically between the first conductive element and the first branch of the individual one of the third pair of higher frequency band structures; and effecting electromagnetic coupling of a second branch of the individual one of the third pair of higher frequency band structures to the feed via a second electromagnetic coupling element disposed electrically between the first conductive element and the second branch of the individual one of the third pair of higher frequency band structures.

* * * * *